US010598470B1

(12) United States Patent
Sanford

(10) Patent No.: US 10,598,470 B1
(45) Date of Patent: Mar. 24, 2020

(54) BROADHEAD

(71) Applicant: Chris G. Sanford, Molt, MT (US)

(72) Inventor: Chris G. Sanford, Molt, MT (US)

( * ) Notice: Subject to any disclaimer, the term of this patent is extended or adjusted under 35 U.S.C. 154(b) by 0 days.

(21) Appl. No.: 16/149,377

(22) Filed: Oct. 2, 2018

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | |
|---|---|---|---|
| 3,672,677 | A | 6/1972 | Moore |
| 6,517,454 | B2 | 2/2003 | Barrie et al. |
| 6,626,776 | B2 | 9/2003 | Barrie et al. |
| 6,669,586 | B2 | 12/2003 | Barrie et al. |
| 6,935,976 | B1 | 8/2005 | Grace et al. |
| 7,234,220 | B1 | 6/2007 | Grace, Jr. |
| 7,771,298 | B2 | 8/2010 | Pulkrabek |
| 8,147,361 | B1 | 4/2012 | Weaver |
| 8,197,367 | B2 | 6/2012 | Pulkrabek et al. |
| 8,398,510 | B1 | 3/2013 | Mizek et al. |
| RE44,144 | E | 4/2013 | Barrie et al. |
| 8,469,842 | B2 | 6/2013 | Mizek et al. |
| 8,469,843 | B2 | 6/2013 | Mizek et al. |
| 8,512,179 | B2 | 8/2013 | Pulkrabek et al. |
| 8,905,874 | B2 | 12/2014 | Sullivan et al. |
| 8,911,311 | B1 | 12/2014 | Sullivan et al. |
| 8,926,457 | B2 | 1/2015 | Treto |
| 8,986,141 | B2 | 3/2015 | Pedersen |
| 9,068,806 | B2 | 6/2015 | Pedersen |
| 9,170,078 | B2 | 10/2015 | Pedersen |
| 9,228,813 | B1 | 1/2016 | Pedersen |
| 9,267,773 | B2 | 2/2016 | Mizek |
| 9,341,449 | B2 | 5/2016 | Pedersen |
| 9,372,056 | B2 | 6/2016 | Sullivan et al. |
| 9,404,722 | B2 | 8/2016 | Pedersen |
| 9,605,933 | B2 | 3/2017 | Pedersen |
| 9,803,962 | B2 | 10/2017 | Hahn |
| 10,012,486 | B2 | 7/2018 | Pedersen |
| 2009/0203477 | A1 | 8/2009 | Mizek et al. |
| 2012/0178560 | A1 | 7/2012 | Grace et al. |
| 2015/0354928 | A1 | 12/2015 | Mizek |
| 2016/0047637 | A1 | 2/2016 | Salvino et al. |
| 2016/0195377 | A1 | 7/2016 | Mizek |

FOREIGN PATENT DOCUMENTS

| | | |
|---|---|---|
| CA | 2614446 | 12/2008 |
| CA | 2757738 | 6/2012 |
| EP | 2977712 | 1/2016 |
| EP | 3062061 | 8/2016 |
| WO | WO2014168800 | 10/2014 |

*Primary Examiner* — John A Ricci
(74) *Attorney, Agent, or Firm* — Becker Patent Law, LLC

(57) ABSTRACT

A broadhead has at least two overlapping blades received within an elongated groove, each blade having a blade extension, the blade extensions extending in opposite directions.

23 Claims, 27 Drawing Sheets

BROADHEAD

BACKGROUND

The present disclosure relates to a broadhead with retracted blades that pivot outwardly into an expanded position upon target contact and more particularly, but not by way of limitation, to an arrow broadhead having a cutting blade housing body with an elongated groove extending along a portion of a length of the housing body. The groove is used to receive a pair of cutting blades. The cutting blades are received in opposite sides of the groove when the broadhead is in a retracted position during arrow flight. Upon target contact, the blades may pivot outwardly from the sides of the groove into an expanded position for maximum cutting and target penetration.

BRIEF DESCRIPTION OF THE DRAWINGS

The accompanying drawings illustrate various embodiments for broadheads in which.

DETAILED DESCRIPTION OF EXEMPLARY EMBODIMENTS

Figure 1:
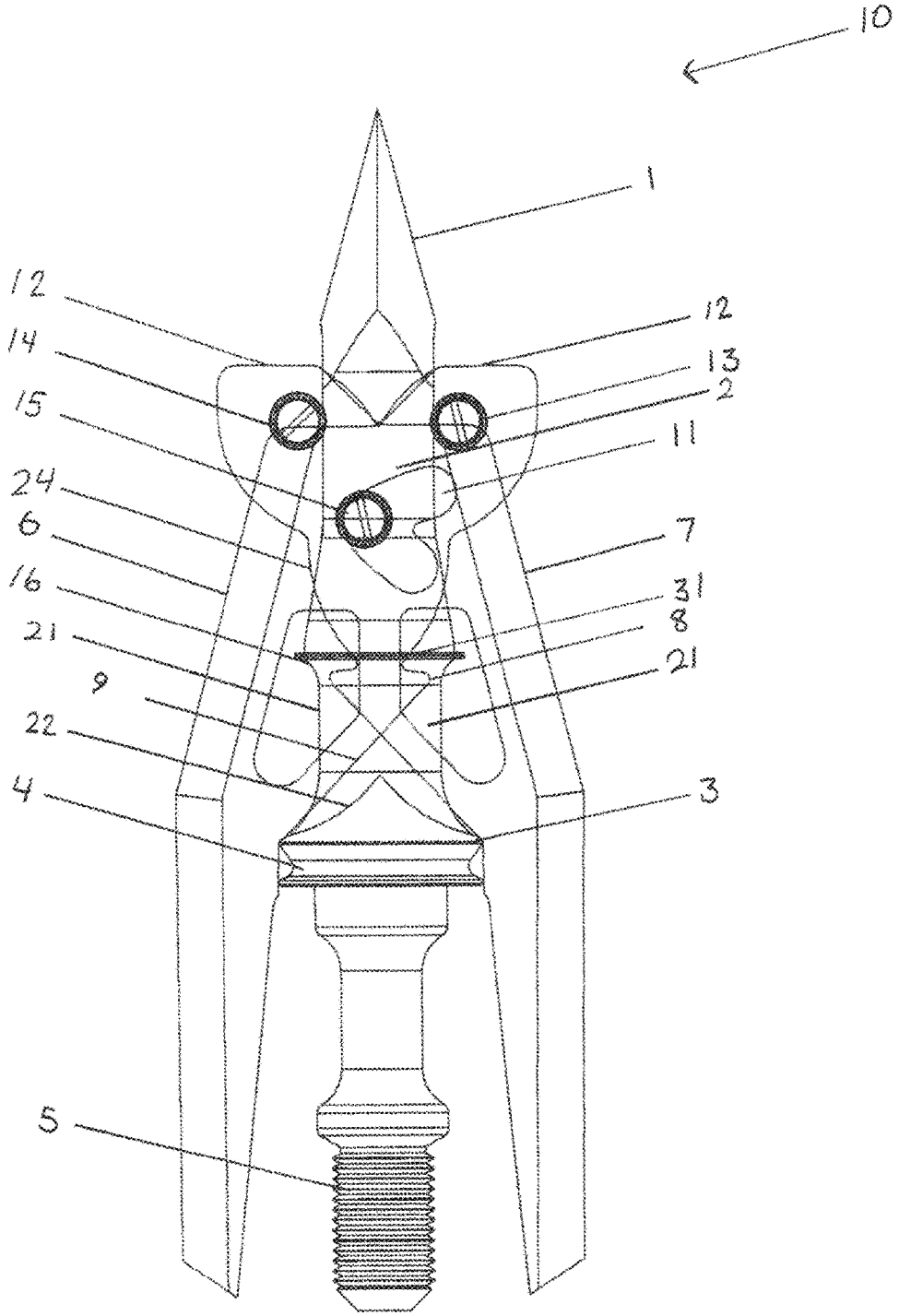
FIG. 1 is a front view of an arrow broadhead with a pair of cutting blades received inside an elongated groove in the housing body, according to an exemplary embodiment. This is an in-flight position. The blades are retracted inwardly toward the housing body.

Various embodiments provide a broadhead with a pair of cutting blades in a retracted position in a groove in a cutting blade housing body during arrow flight, hold the cutting blades in an expanded, locked position during target contact, and then allow the cutting blades to fold forward for ease in release when the broadhead is pulled outwardly from the target which may make it a non-barbed design.

Other embodiments illustrate how an arrow broadhead housing can include a tip that allows detachment from the housing body. The separate, detachable tip can be attached to a top portion of the housing body, which may allow the rotating, sliding, or pivoting cutting blades to be received in the elongated groove. This feature may allow for a connected pair of blades or at least one blade to be received in an elongated groove.

Still other embodiments relate to multiple features or blade extensions on cutting blades to be received in a cutting blade housing body or elongated groove. The blade extensions can be in the form of a bend in the blade, an extrusion on the blade, a bump or outward extension from the blade, a screw in the blade, a rivet in the blade, a screw pin, a protruding portion of the blade, a molded outward portion on the blade, or other extensions. The blade extrusion can be of different shapes, sizes, and combinations thereof. This blade feature can be any makeup that creates a non-parallel portion to the blade length. This feature may allow the blade or blades to be received within the elongated groove.

Still other embodiments relate to the blade or blades extending from one side of the housing body through the other side of the housing body.

Still other embodiments relate to a pair of cutting blades crossed over one another and at least partially received in an elongated groove or slot in the housing body. The blades have a forward portion that, upon target contact, push rearwardly and move the blades outward into an expanded position for increased cutting and penetration in the target.

Still other embodiments relate to using the broadhead's forward inertia to hold the cutting blades in the elongated groove in the housing body to approximately upon target contact, then moving the cutting blades into a fully expanded and locked position. The forward inertia of the arrow broadhead and the extension of the blades may provide for an improved cutting and tissue damage to the intended target. This feature results in larger entry and exit holes in the target, better blood trails and higher game recovery.

Still other embodiments relate to various blade retention devices to hold the blades into a retracted in-flight position during arrow flight. The blade retention devices can be a steel ring, o-ring, rubber ring, half ring, plastic clip over any portion of the blades, spring ring, half ring, tension ring, tension ring pushing on blades, tension ring covering blades, tension ring pulling blades inward, tension wire, tension wire pulling on blade extrusions and keeping blades retracted, tension ring pushing against the blades, torsional spring or tension clip over a portion of the blades or pressing against the blades, of any size, shape, or combinations thereof.

In one embodiment the broadhead may include a pair of cutting blades received in an elongated groove in a cutting blade housing body. The cutting blades may be folded into a portion of the groove during arrow flight. Upon target contact, the blades may be configured to move rearward and outward from opposite sides of the groove into an expanded position for increased cutting and penetration in the target.

In some embodiments, a plurality of blades can overlap each other within a channel of a body or ferrule.

In some embodiments, blade extensions on each blade can be configured to contact and move along an outer surface of the ferrule without being confined to moving within a channel of the ferrule.

In some embodiments, providing blade extensions on one side of each blade extending in opposite directions allows the blades to overlap each other while still being able to rotate, and may further allow the blades to be kept in a smaller, gather or more compressed circumference during an in-flight position for better aerodynamics and flight. Opposing blade extensions extending from one side of each blade may further allow the blades to rotate freely from a retracted in-flight position to an extended cutting position to a non-barbed position.

In some embodiments, blade extensions may be configured to couple the blades to the housing body and may further be configured to align the blades to slide rearward into an expanded cutting position.

In some embodiments, an additional blade extension on an inner portion of the blade (extending opposite the aforementioned blade extension) and the blade slot on the opposite blade may couple the two blades together within the elongated groove of the ferrule which may allow the blades to rotate freely from a retracted in-flight position, to an extended cutting position, to a non-barbed position, while retaining the blades within the body.

In some embodiments, a broadhead body may comprise an exterior or outside bump or may have a recessed portion for the blade extensions to lock the blades into an expanded position. In some embodiments, the blade extensions are configured to hook over this portion of the body and pry against the body to lock the blades into an expanded cutting position.

In some embodiments, the blades may be coupled together and to the body without requiring the use of fasteners on the body to retain the blades.

In some embodiments, the blade extension may be removable to allow the blades to be inserted in a body or elongated groove without having a slot completely through the end of the body or without having to remove a tip to insert the blades.

The various features of the embodiments disclosed herein show novel construction, combination, and elements as described, and more particularly defined by the claims, it being understood that changes in the embodiments to the disclosed invention are meant to be included as coming within the scope of the claims. In FIG. 1, a front view of the subject broadhead is shown, having a general reference number 10. The broadhead 10 is illustrated in-flight. The broadhead 10 includes a housing body 2, having a pointed tip 1 and a threaded end 5 used for attaching the broadhead 10 to a hollow arrow shaft insert. It should be noted that broadhead 10 can be glued, press fit, or attached to an arrow without the use of threaded end 5. Broadhead 10 can be made as an extension of an arrow, bolt, or any combination thereof. The arrow shaft and insert aren't shown in the drawings. The housing body 2 has an elongated groove 21 extending from inner bottom portion 22 to a top portion of body 2, the groove 21 receives a pair of cutting blades 6 and 7. It should be noted that the elongated groove 21 can be a slot, groove, cut out, hole, recess, etc. to assist in receiving at least one cutting blade. It should also be noted that the elongated groove 21 can be of different depths, shapes, partial, full through, and can be through the tip 1 or without a tip 1.

Also shown in this front view are cutting blades 6 and 7 received in housing body 2 and overlapping one another in at least one position and optionally in all positions of the movable blades. The cutting blades 6 and 7 are illustrated each with an extension 13 and 14 that protrudes outward in opposite or opposing directions so the blades 6 and 7 can slide or rotate. Extensions 13 and 14 may extend normal, perpendicular, or transverse to a major plane defined by the respective blade of each extension. The extensions 13 and 14 may help align and retain the blades 6 and 7 within the housing body 2. Extensions 13 and 14 can be of various shapes and sizes and may compromise an addition, protruding portion, bend, rivet, screw, pin, extrusion, nut or bolt, forged metal or composite, removable or detachable from blade, permanent, integrally formed with the blade, or any combination thereof. Each of blades 6 and 7 can also have multiple extensions to retain the blade or blades within the elongated groove 21 of housing body 2 (e.g., one extension disposed on each opposing side of groove 21, or other configuration). There may also be a member or extension 15 on blade 7 that protrudes in the opposite direction of extension 14. This member 15 is received in receiving slot 11 of blade 6. The member 15 and slot 11 may help couple blades 6 and 7 together. Blade member 15 can also be various shapes, sizes, permanently fixed to blade, forged to blade, a blade extension, removable or detachable from a blade, a loose shape piece of any shape, bump, a protruding portion, rivet, screw, pin, extrusion, nut or bolt, bend or any combination thereof. The slot 11 can also be of various shapes, sizes, open, closed and different combinations thereof. In this embodiment, slot 11 is substantially v-shaped. Blade extensions can be received in slots that are in different locations on or in housing body 2, for example in a top end portion, a middle portion, a bottom end portion, etc. In some embodiments, blade 6 and/or blade 7 may have an extension on only one side of the blade and not on both sides of the blade.

Figure 2:
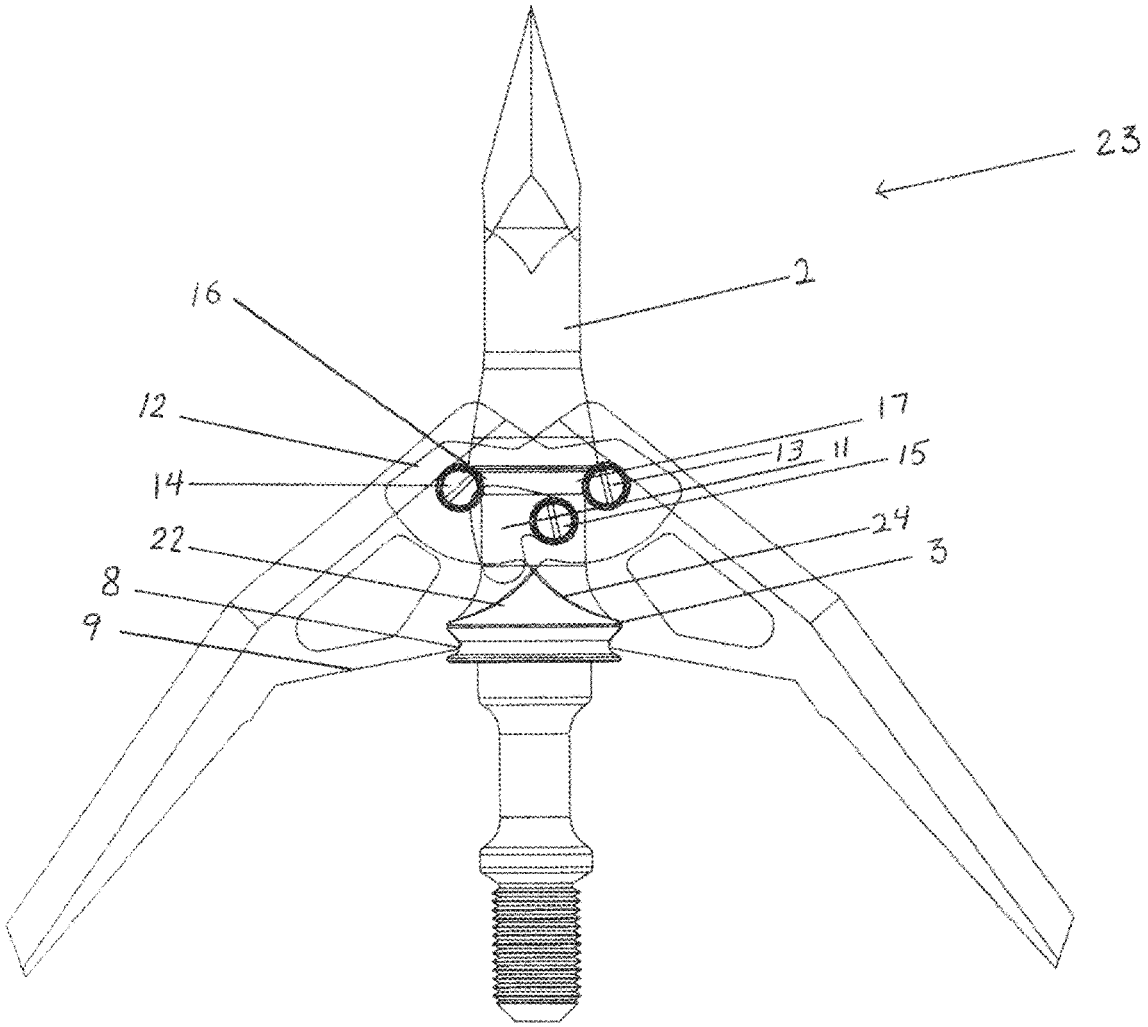
FIG. 2 is another front view of the broadhead, as shown in FIG. 1, with the blades expanded outwardly for maximum cutting and target penetration.

In FIG. 2 an expanded and locked illustration of a broadhead is shown with an angle portion 16 and 17 of housing body 2. This angle portion 16 and 17 can be a groove, cut out, bump out, hook, recess, or any combination thereof. Angle portion 16, 17 may comprise a bump out portion of housing body 2 where the blade extensions lock into and pry against upper inner blade 24 and out bottom portion 3. This bump may comprise any area on the outside portion of housing body 2 that the blade extensions are captured in and prevent the blade from sliding upward on the body and unlocking the blades or slide forward back in towards the in-flight position. Upon target contact, the front portion 12 of blades 6 and 7 push blades backward and inner blade portion 9 can contact outer bottom portion 3 or inner bottom portion 22 of housing body 2 that can help rotate or slide blades 6 and 7 outwardly into an expanded cutting position. Upon target contact, blade extensions 13 and 14 can also help push and rotate blades 6 and 7 outwardly into an expanded cutting position. Upon target contact, blade extension 15 and receiving slot 11 may align and assist blades 6 and 7 to move rearward and outwardly, and then upon target contact, blade extension 15 locks into blade slot 11 and holds the blades into an expanded locked position. Also, upon target contact, blade extensions 13 and 14 may slide rearward on the outer portion or surface of housing body 2 and then lock into portion 16 and 17 of housing body 2. This locks blades 6 and 7 into an expanded cutting position 23. Blade extensions 13 and 14 push or press against upper inner blade 24 and lock blades 6 and 7 into an expanded cutting position. Also shown in FIG. 2 is blade locking notch 8 or protrusion that hooks or locks over or against lower portion 3 of housing body 2 having a circumferential groove defined therein. In this illustration, lower portion blade lock notch 8 lock the blades 6 and 7 into an expanded cutting position, but bottom portion 3 can compromise a flat surface or angled surface of various shapes and angles. Blade lock notch 8 can also be a flat surface, angled surface, or various shapes or angles or combinations thereof. Blades 6 and 7 can lock open into an expanded cutting position by use of blade extensions 13 and 14 or by blade lock notch 8 over bottom portion 3 or any combination thereof. Other blade extensions and combinations thereof can also be used to lock the blades into an expanded cutting position.

Figure 3:
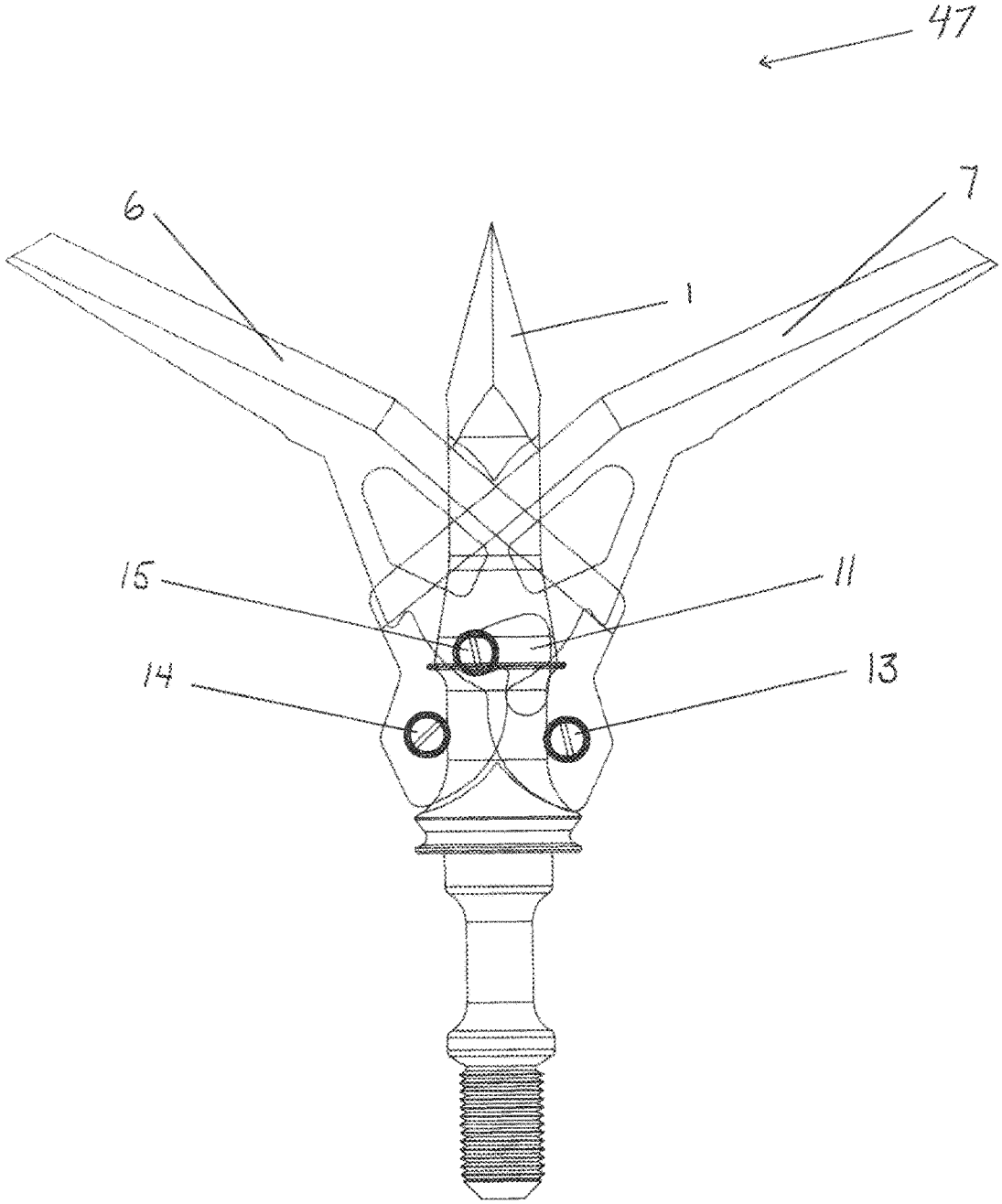
FIG. 3 is still another front view of the broadhead, as shown in FIG. 1, with the cutting blades pulled rearwardly and pointing forwardly for releasing the broadhead from the target and illustrating a non-barbed design.

In FIG. 3 a front view of the subject arrow broadhead is shown in a non-barbed position 47. The blades 6 and 7 are folded forward for easy release from the target. In this illustration, the extensions 13, 14, and 15 still allow the blades 6 and 7 to rotate forward into the non-barbed position 47. While the blades 6 and 7 are illustrated in a locked position 23 in FIG. 2, the blades 6 and 7 can still rotate forward to this non-barbed position 47.

Figure 4:
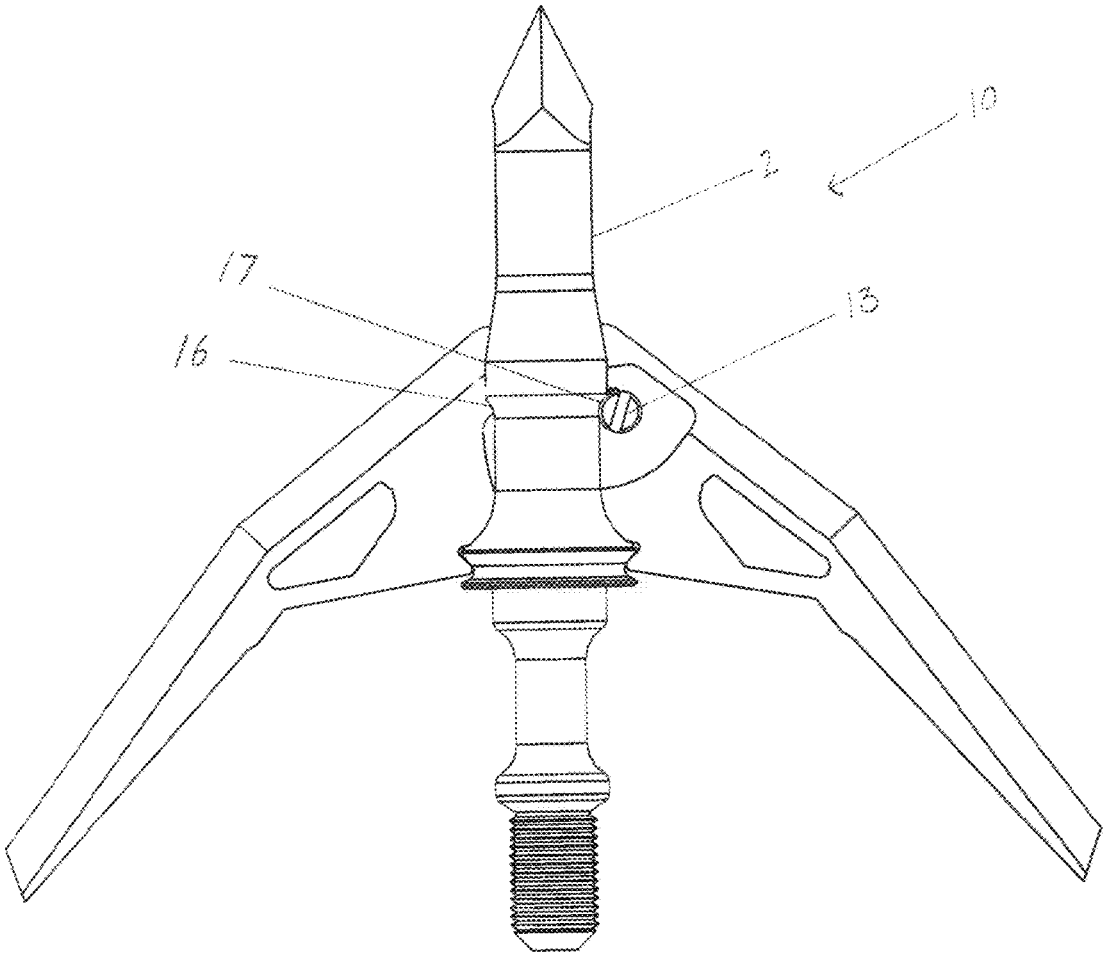
FIG. 4 is a front view of another embodiment of the arrow broadhead with each cutting blade illustrating a first extension on one side and a second extension on the opposite side (not shown in this drawing) to receive the blades in an elongated groove in the housing body.

In FIG. 4, still another front view of the subject broadhead 10 in an expanded and locked position illustrates how blade extension 13 of blade 6 is locked in and against angle portion 17 of housing body 2. Blade extension 14 of blade 7 is locked in against angle portion 16 on the opposite side (not shown in this drawing).

Figure 5:
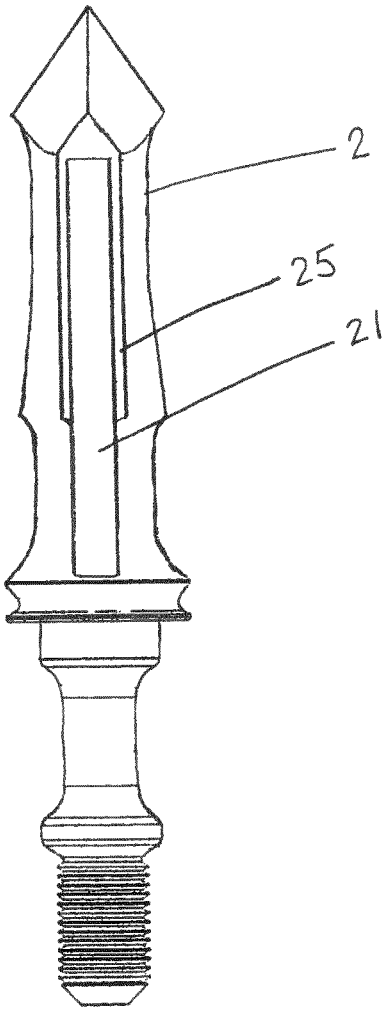
FIG. 5 is a side view of the housing body shown in FIG. 1, without the cutting blades. This illustration shows the elongated groove through a portion of the housing body.

In FIG. 5, is another perspective side view of housing body 2. In this view, the elongated groove 21 is illustrated through a portion of housing body 2. There is also a flat portion 25 for blade extensions 13 and 14 to easily slide on while blades 6 and 7 move rearwardly into an expanded and locked cutting position 23. It should be noted, blade extensions 13 and 14 can still slide or move rearwardly without flat portion 25. Blade extensions 13 and 14 can also slide in a rail or outer portion slot or elongated groove of housing body 2.

Figure 6:
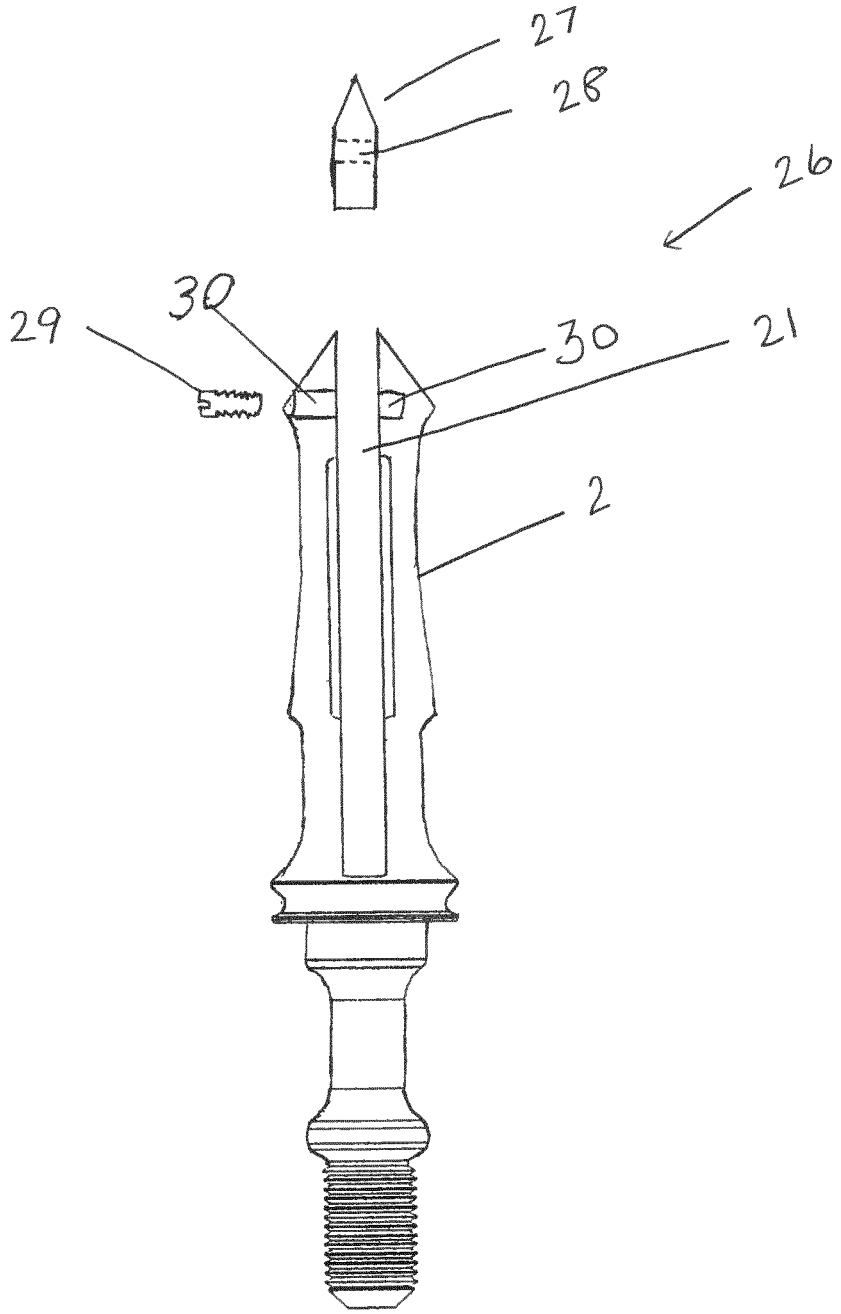
FIG. 6 is still another side view of another embodiment of an arrow broadhead with a removable bladed tip to receive a pair of cutting blades in the elongated groove.

FIG. 6 is another side view of an embodiment 26. In this illustration, the embodiment 26 has a replaceable blade tip 27 that is coupled to housing body 2 with a screw pin 29 through opening 28 of bladed tip 27 and coupled together through another housing body opening 30 in housing body 2. Opening 28 and 30 can be threaded to receive bladed tip 27 with screw pin 29. It should be noted that bladed tip 27 can be coupled to housing body 2 with a screw, pin, press fit, glue, weld, or any other application to receive the tip. It should also be noted that the tip can be a rounded flat, cone shape, diamond shape, or of various shapes and sizes. Also illustrated in FIG. 6 is the elongated groove 21 extended through front portion of housing body 2 allowing blades 6 and 7 to be received without removing any blade extensions 13, 14, 15, or other multiple blade extensions.

Figure 7:
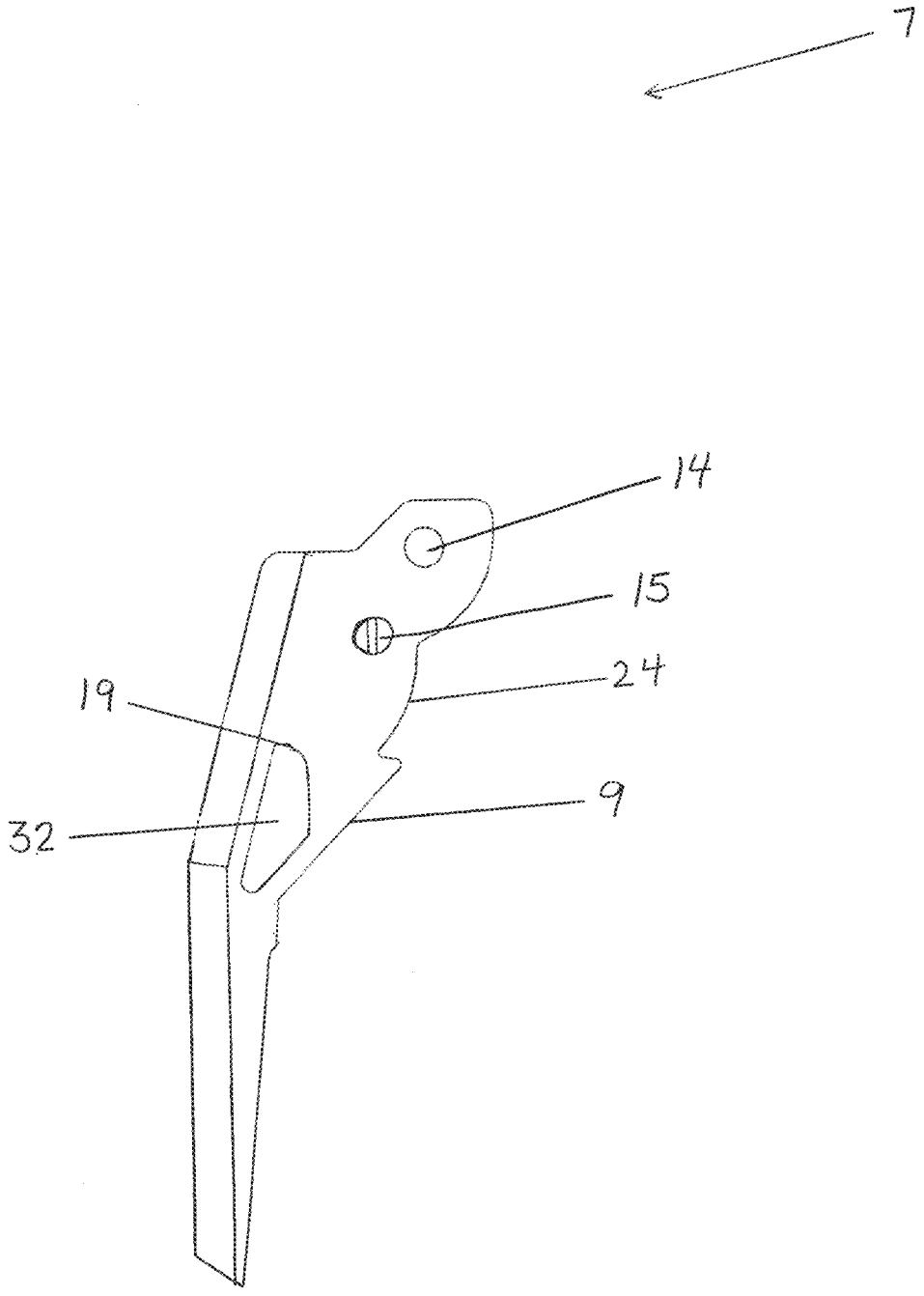
FIG. 7 is an illustration of a first blade with blade extrusions on opposite sides of the blade.

In FIG. 7 is an illustration of blade 7 with blade extensions 14 and 15 and inner lower blade portion 9 and inner upper portion blade portion 24. Also shown is blade retention notch 19. The tension clip 31 (not shown in this FIG. 7) may be received in the blade retention notch 19 to hold the blades inwardly for the in-flight retracted position 10 as shown in FIG. 1. It should be noted that blade receiving notch 19 can be any shape or size and on any location of blade 6 or 7. Also in FIG. 7 is blade cut out 32. This cut out can also be any size or shape.

Figure 8:
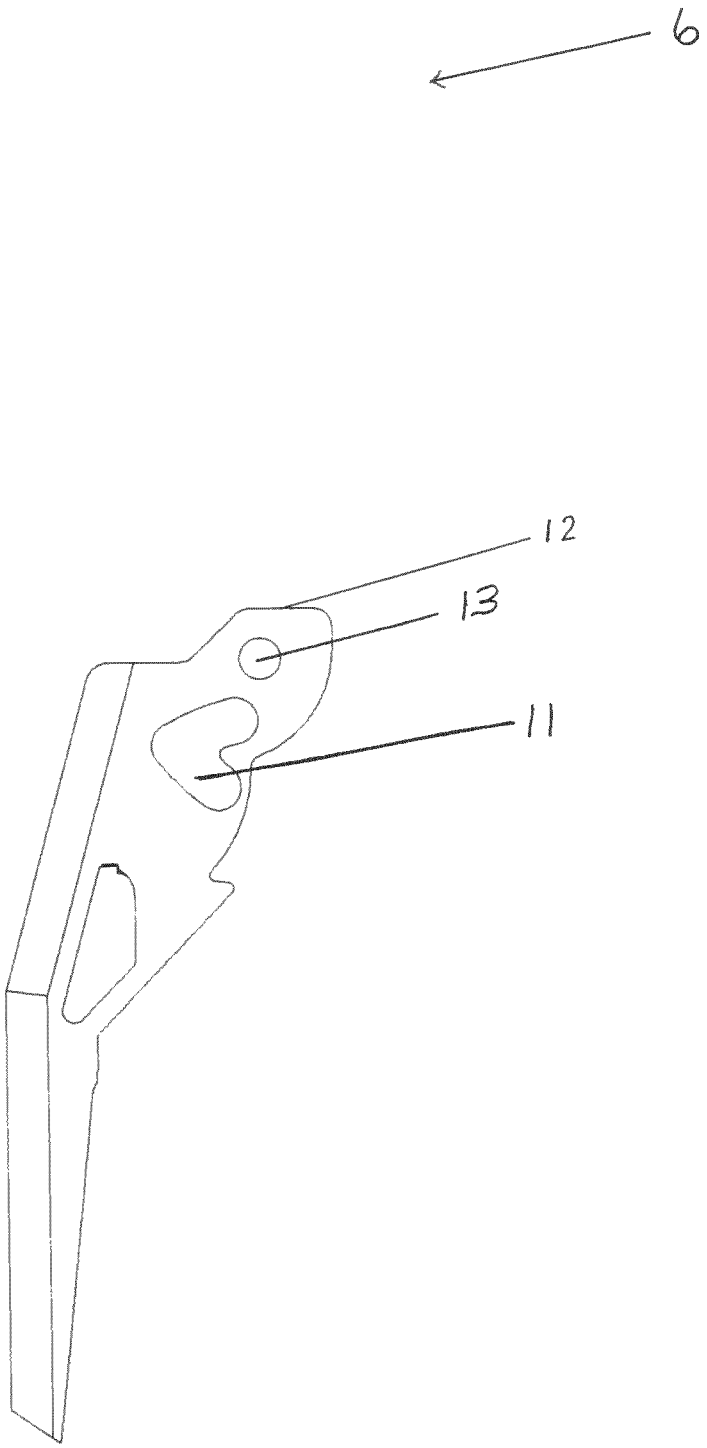
FIG. 8 is an illustration of a second blade with a blade extrusion and a receiving slot.

In FIG. 8 is an illustration of blade 6 with blade extension 13 and receiving slot 11. Blade extension 15 (not shown in this drawing) may be received in receiving slot 11 of blade 6. It should be noted that blade slot 11 can be a cut-out, elongated groove, line, or slot that is open and continues through the edge of blade 6 allowing a blade extension 15 to not be fully contained in receiving slot 11. With blade extension 15 received in receiving slot 11, blades 6 and 7 are coupled together, yet still able to pivot, slide, and rotate. Also shown in this illustration is front portion 12 that helps push and rotate blade 6 backwardly and rearwardly into expanded cutting position.

Figure 9:
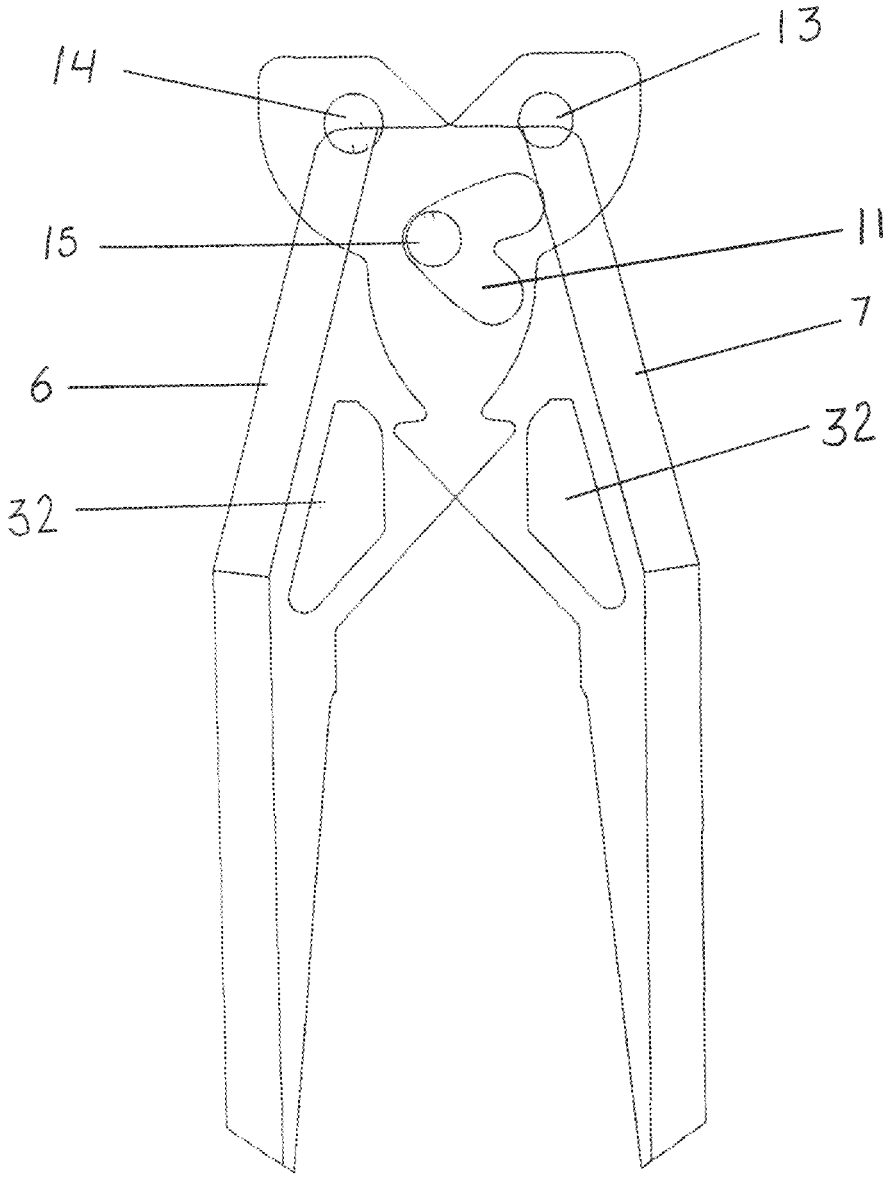
FIG. 9 is an illustration of a first blade overlapping the second blade without the housing body as shown in FIG. 1. This illustration also shows the blades coupled together with a blade extension and receiving slot.

In FIG. 9 is an illustration of blades 6 and 7 in the retracted position and without housing body 2 shown. In this illustration, blade extension 15 is shown in receiving slot 11 in a different position.

Figure 10:
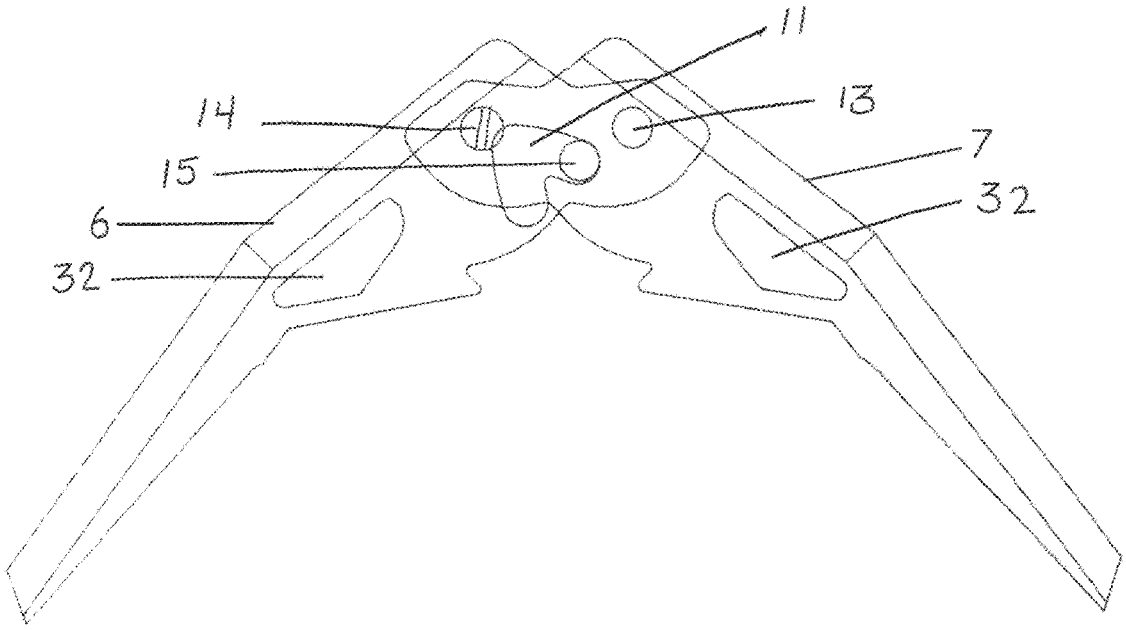
FIG. 10 is an illustration of a first and second blade in the expanded position without the housing body as shown in FIG. 1.

In FIG. 10 is an illustration of blades 6 and 7 in the expanded cutting position and without housing body 2 shown. In this illustration, blade extension 15 is shown in a locked position in receiving slot 11.

Figure 11:
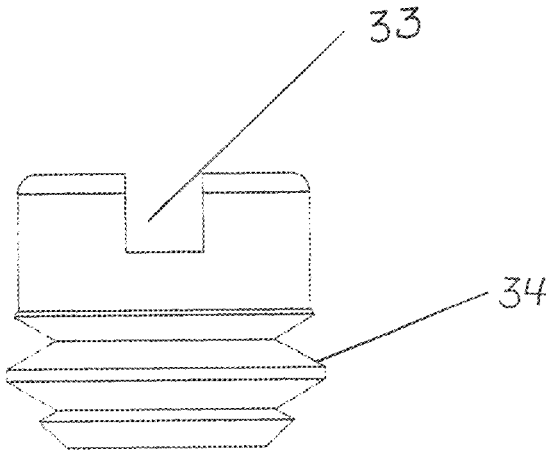
FIG. 11 is an illustration of examples of blade extrusions or blade extensions.
Figure 11:
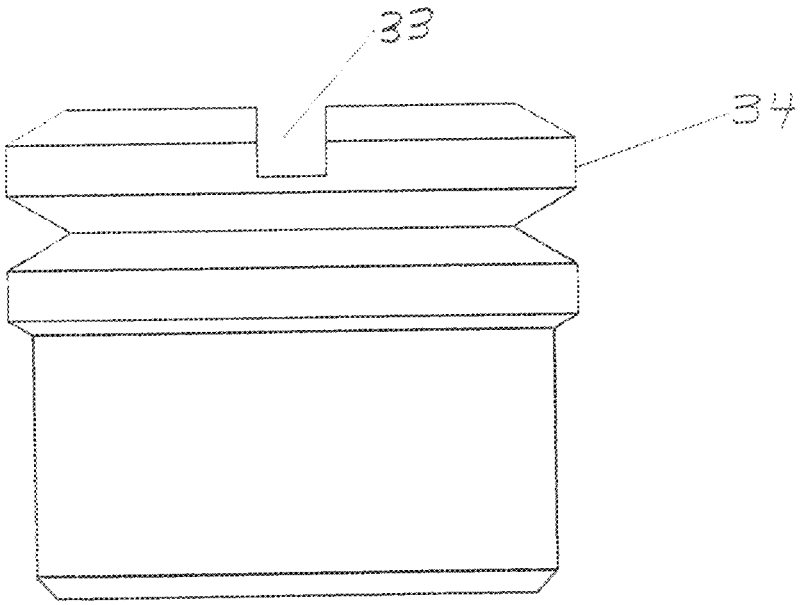

FIG. 11 is an illustration of blade extension 13, 14, and 15. Groove 33 is used to allow a screwdriver to rotate blade extension into blade 6 and 7 to be received using threads 34. It should be noted that blade extensions can be any size or shape and be a permanent part of blade 6 or 7 or can be a detachable part of blade 6 or 7. It should be noted that blade extension 13, 14, 15 can be of various shapes, sizes, addition, protruding portion, screw, nut or bolt, bend, rivet, pin, extrusion, removable, permanent, or any combination thereof.

Figure 12:
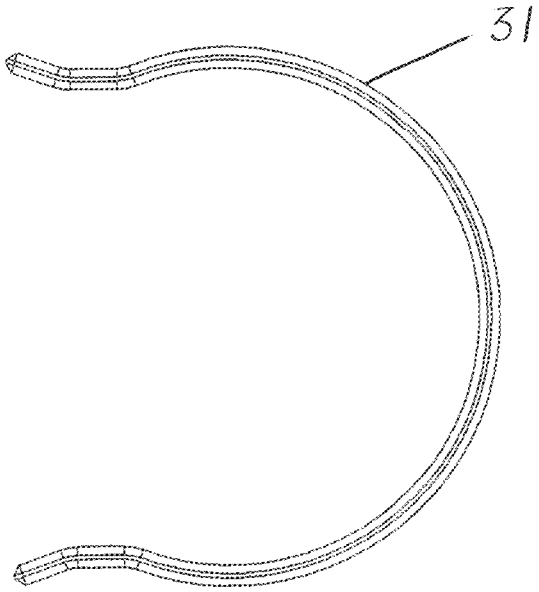
FIG. 12 is an illustration of an example of a spring clip or tension clip as shown in FIG. 1.

In FIG. 12 is an illustration of tension clip 31 that holds blades 6 and 7 (not shown in this drawing) in the retracted in-flight position 10 by being received in blade receiving notch 19 (also not shown in this drawing). It should be noted that the blade retention devices can be a steel ring, plastic or carbon clip, o-ring, rubber band ring, half ring, spring ring, tension ring, tension ring pushing on blades, tension ring covering blades, tension ring pulling blades inward, tension wire, tension wire pulling on blade extrusions and keeping blades retracted, plastic clip, tension wire or spring washer pushing against the blades, torsional spring or tension clip over any portion of the blades or pressing against the blades, of any size, shape, or combinations thereof.

Figure 12A:
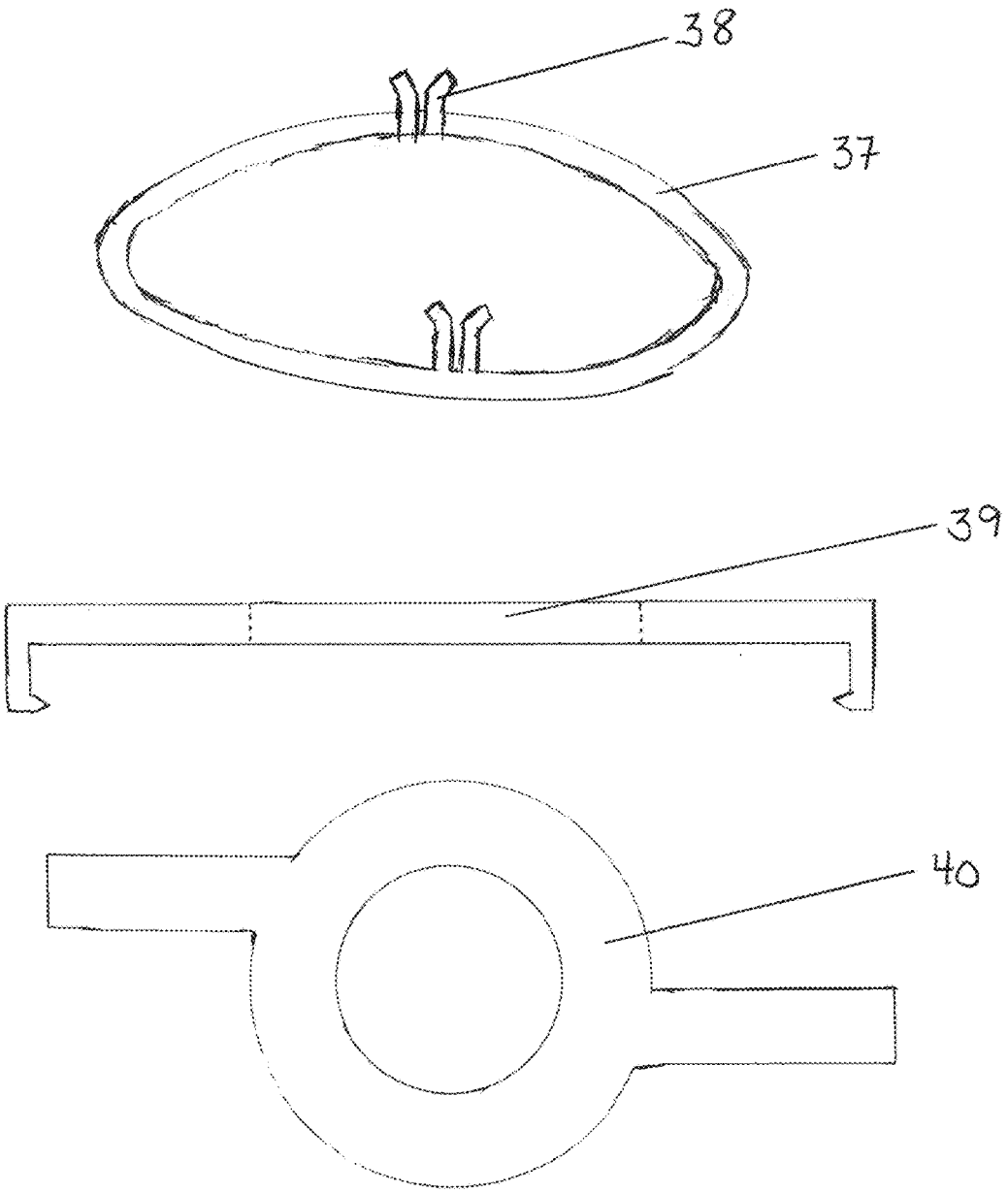
FIG. 12A are illustrations of various blade retention devices that hold and press the blades keeping them in a retracted in-flight position.

FIG. 12A illustrates different embodiments of blade retention devices that can be used in the current invention. Blade retention device 37 has extending tabs 38 that hold or press the blades to retain them in a retracted in-flight position. Extending tabs 38 can be angled upward (perpendicular) or outward more (parallel) to retention device 37. Blade retention 39 hooks over a blade 6, 7, or blade extensions 13 and 14 to keep the blades in a retracted in-flight position. In an alternative embodiment, blade retention device 40 can go over the broadhead tip or over the back portion of broadhead 2 and hook or press over the blades or blade extensions using a similar hook device as shown with reference to blade retention device 39. These blade retention devices 39 and 37 and 40 can also be various shapes and sizes and angles and combinations thereof.

Figure 12B:
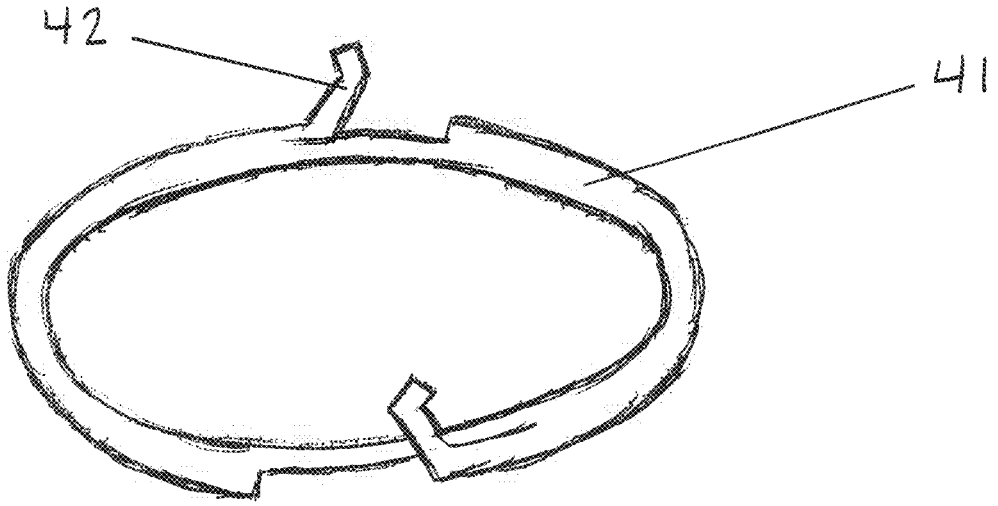
FIG. 12B is yet another example of a blade retention device that holds or attaches to the blades to hold them in a retracted in-flight position.

FIG. 12B is another embodiment of a blade retention device 41 that has an extending tab 42 that can be used to hook or press against blades to hold them in a retracted in-flight position. Extending tabs 42 can be angled upward (perpendicular) or outward more parallel to retention device 41. It should also be noted that there are other ways to hold the blades together while still coming within the scope of the current disclosure.

It should also be noted that these blade retention devices can be made with rubber, plastic, metal, carbon, or any material to form a shape or blade retaining device. From the above discussion of different types of cutting blade retention devices, it can be appreciated that other examples of spring clips, rings, banding, washers, clips, combinations and similar retracting devices can be used equally well for holding the cutting blades in the retracted position during arrow flight and prior to target contact.

It should be mentioned that the various blade retention means shown in the drawings for holding the cutting blades in a retracted position during arrow flight can be used equally well for other embodiments of the broadhead disclosed herein.

Figure 13:
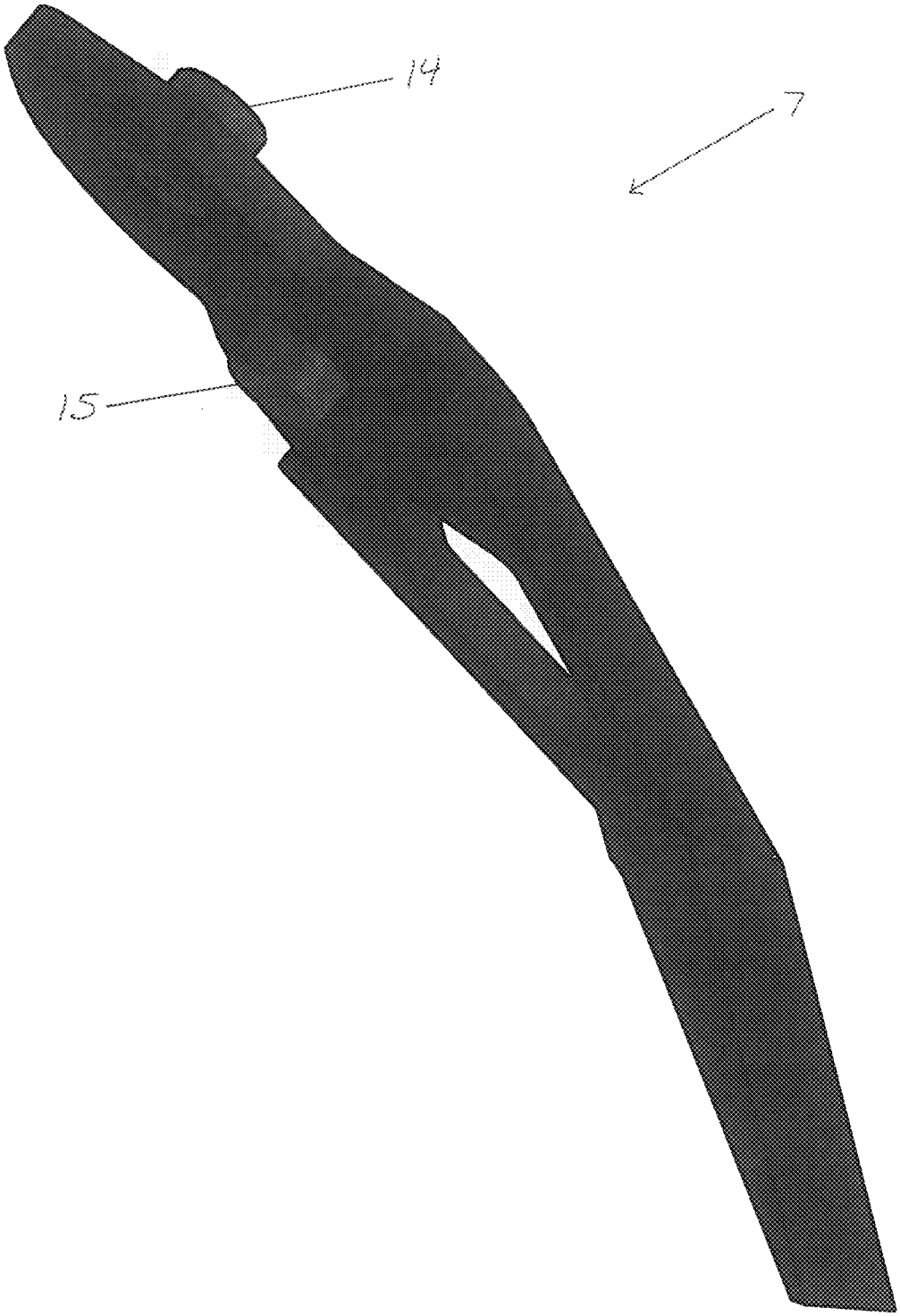
FIG. 13 is an angled view illustration of an example of a blade with blade extensions on opposite sides of the blade.

FIG. 13 is an illustration of blade 7 with a blade extension 14 and another blade extension 15 on the opposite side. In this illustration, the blade extension 14 can be used to slide on an outer portion of the housing body 2 and the blade extension 15 can be used to be received in a portion of the other blade receiving slot 11 that are both received in the housing body 2 (not shown in this drawing). It should be noted that there can be multiple blade extensions on each blade.

Figure 14:
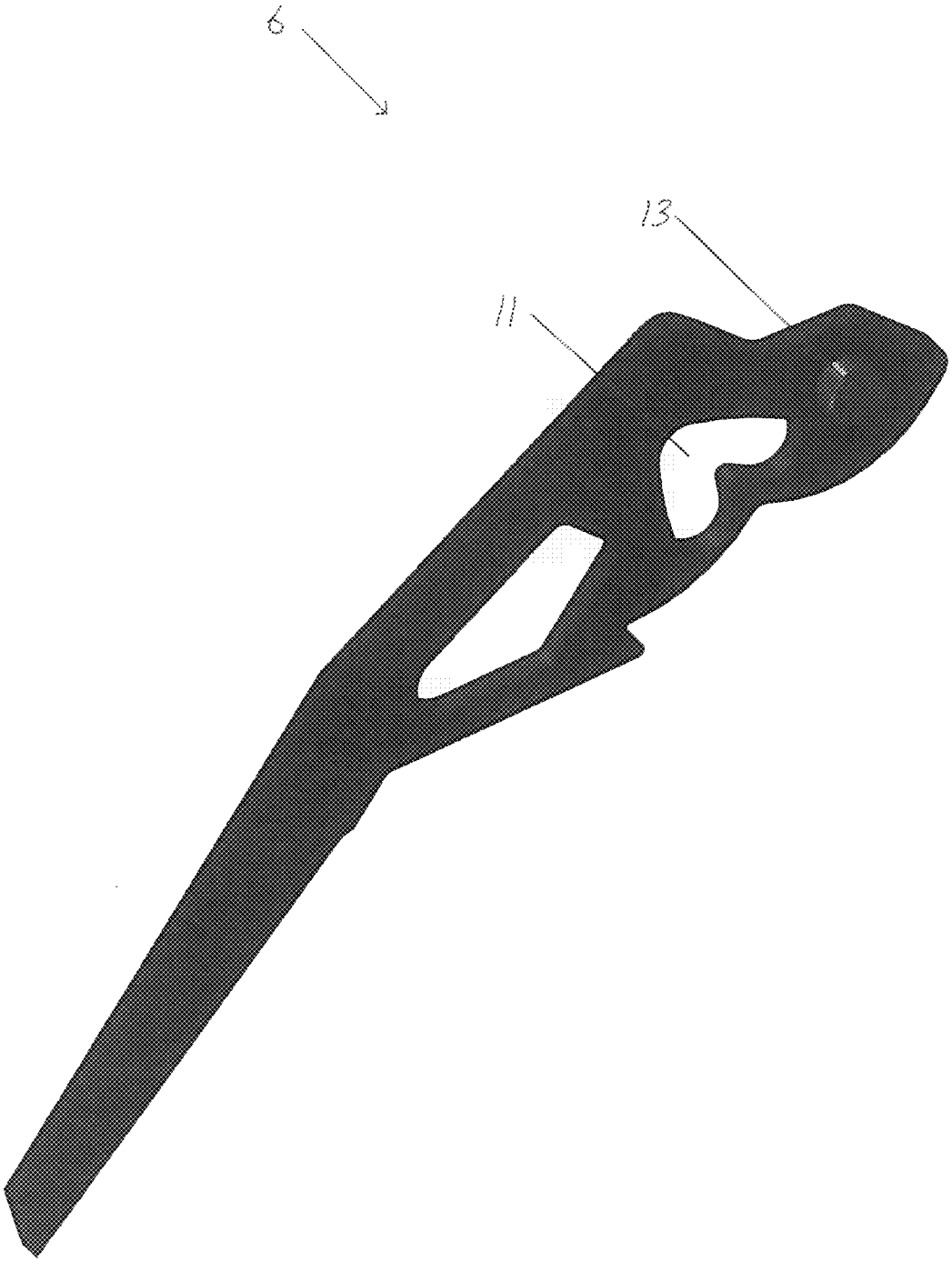
FIG. 14 is an angled view illustration of an opposite blade that also has a blade extension and an elongated groove or cut out portion in the blade for the other blade extension to be received.

FIG. 14 is an illustration of blade 6 with a blade extension 13 and a receiving slot or elongated groove 11. This elongated groove is used to receive the blade extension 15 on blade 7 (not shown in this drawing) to contain the blades within the housing body 2. Elongated groove 11 can also be an open groove or open contour and it can also be a closed groove or slot. Blade 6 can also have multiple blade extensions and eliminate the receiving slot 11, yet still be received in the elongated groove 21 of housing body 2.

Figure 15:
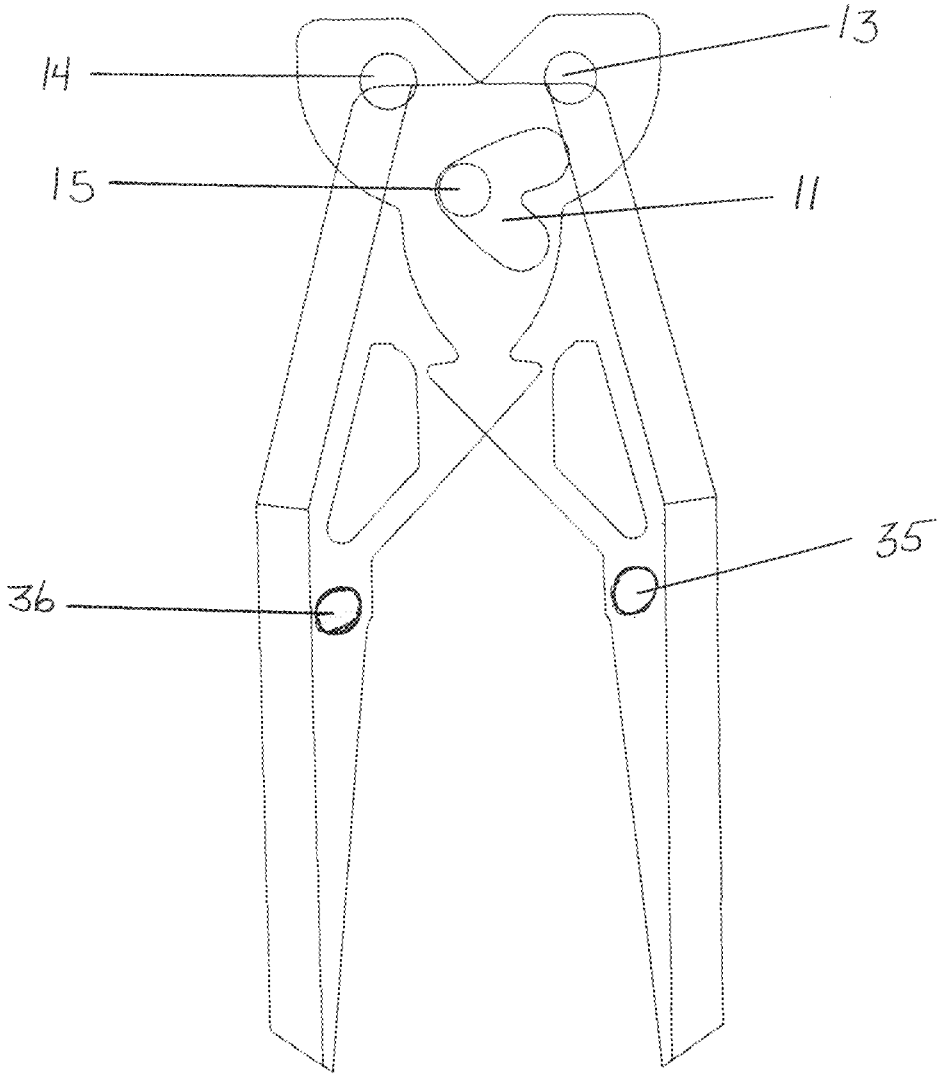
FIG. 15 is another illustration of a two-blade configuration that has multiple blade extensions shown in a retracted in-flight position.

FIG. 15 is an illustration of another two-blade configuration with multiple blade extensions 13, 14, 15, 35, and 36 in a retracted in-flight position. In this configuration, the blade extension 35 and 36 can be added to eliminate blade extension 15 and receiving slot 11 and still be coupled within an elongated groove 21 of housing body 2. In this view, the blades 6 and 7 are shown in a retracted in-flight position. It should be noted that blade extension 15 can also be any shape or size and can also be a loose aperture that does not necessarily have to be connected to either blade, but is still contained within receiving slot 11.

Figure 16:
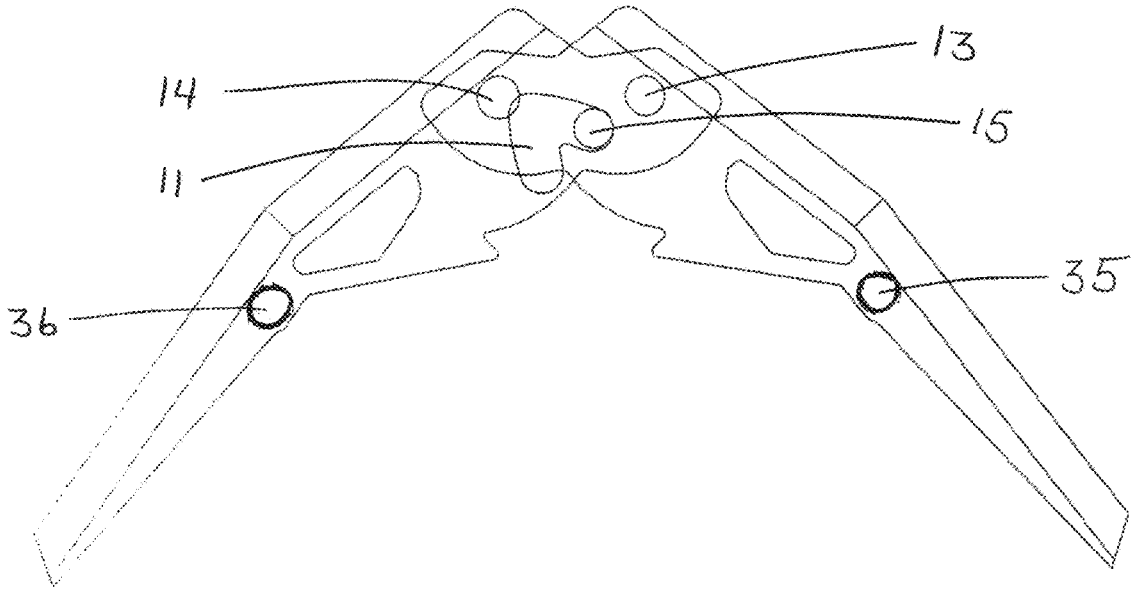
FIG. 16 is another illustration of a two-blade configuration that has multiple blade extensions shown in an expanded position.

FIG. 16 is an illustration of a two-blade configuration with multiple blade extension 13, 14, 15, 35, and 36 in an expanded position. Blade extension 14 can be on the opposite side of the blade extension 35, while blade extension 13 is also on the opposite side of the blade extension 36 allowing the blades 6 and blade 7 to be received in the elongated groove 21 of the housing body 2. In this configuration, you can then eliminate blade extension 15 and receiving slot 11 and still have blades 6 and 7 coupled within the elongated groove 21. It should be noted that multiple blade extensions and configurations can be used on different embodiments to receive the blades to or within other housing bodies and embodiments.

Figure 17:
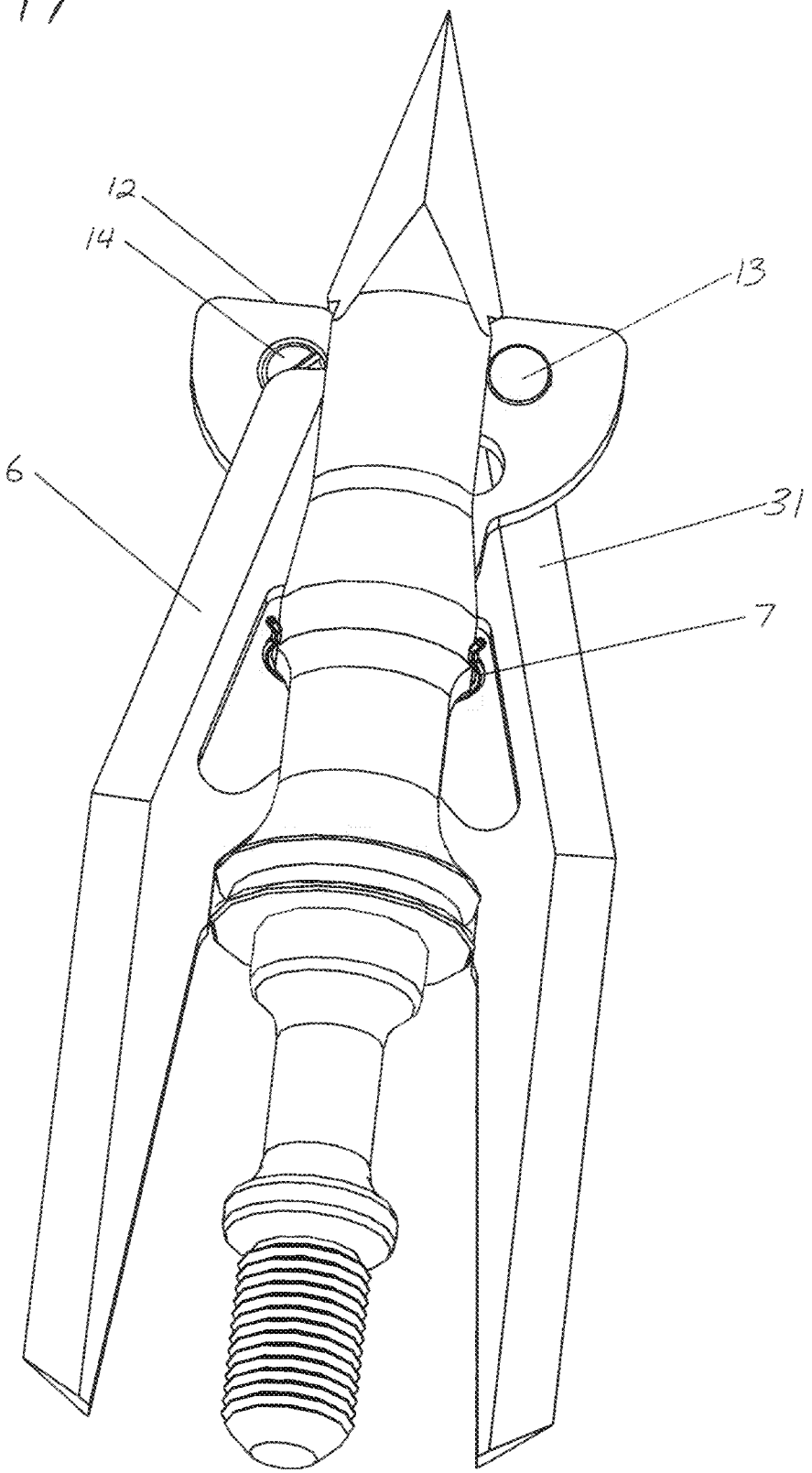
FIG. 17 is an illustration of an angled view of the housing body with a retention clip in the middle portion of the housing body holding the blades in a retracted, in-flight position. This view illustrates the blade extensions on opposite sides and in opposite directions and illustrates how the blade extensions may keep the blades in the elongated grooves.

In FIG. 17 is a front angle view of an embodiment showing a retention clip 31 holding blades 6 and 7 in a retracted in-flight position. It should be noted that blade retention devices can be at various locations on the blades to hold them in the retracted in-flight position. The retention clip can be on the outside, inside, or any other location on the blades for holding them in a retracted position. In this view, blade 6 is overlapping blade 7 in the elongated groove 21 of housing body 2. This view also illustrates how blade extension 13 and blade extension 14 are extending outward in opposite directions and on opposite sides of the housing body 2. These blade extensions going in opposite directions couple blades 6 and 7 within elongated groove 21 and do not interfere with blades 6 and 7 crossing over one another within elongated groove 21. The blade extensions 13 and 14 also help blades slide rearward and align blades while moving from a retracted in-flight position to an expanded cutting position. The blade extensions also lock the blades into an expanded position by pressing against the housing body 2. The blade extensions can further lock the blades into an expanded position by hooking or pressing against the portion 16 and 17 of housing body 2.

Figure 18:
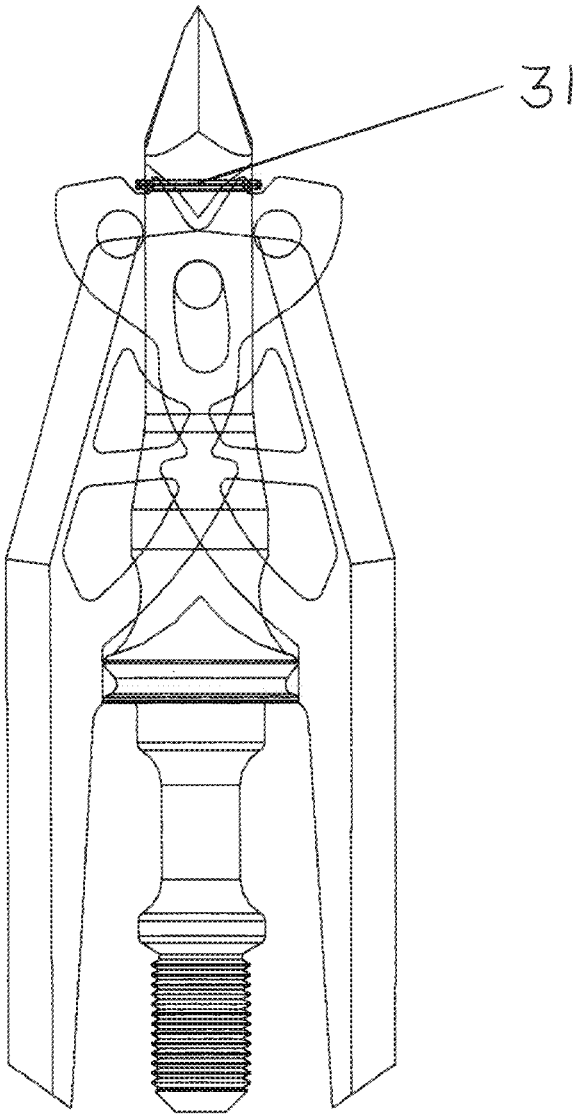
FIG. 18 is another view of a retention clip on the front portion of a housing body, holding the blades in a retracted, in-flight position.

In FIG. 18 is another illustration of a blade retention clip 31 on the top portion of blades 6 and 7 and on the top portion of housing body 2. It should be noted that retention clip 31 can be on the outside portion of blade 6 and 7 or can be clipped over blade extensions 13 and 14, pulling blades 6 and 7 inward to keep them in a retracted in-flight position.

Figure 19:
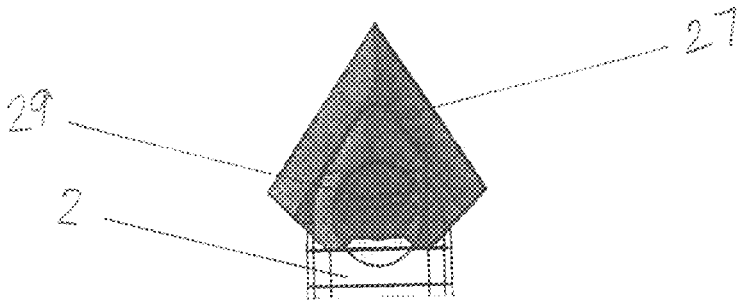
FIG. 19 is a view of a bladed tip that may be attached to the housing body.

In FIG. 19 is yet another embodiment of a bladed tip 27 coupled to housing body 2 with a screw pin 29. With this configuration, the blades 6 and 7 can be removed through housing body 2 by taking out bladed tip 27 and sliding coupled blades into the elongated groove 21 from the top portion of housing body 2. This bladed tip 27 can also be detachable, yet not a portion of the elongated groove 21 of housing body 2. The bladed tip 27 can be in a top portion of the housing body 2 and not be received in the elongated groove 21 but separate from that groove.

Figure 20:
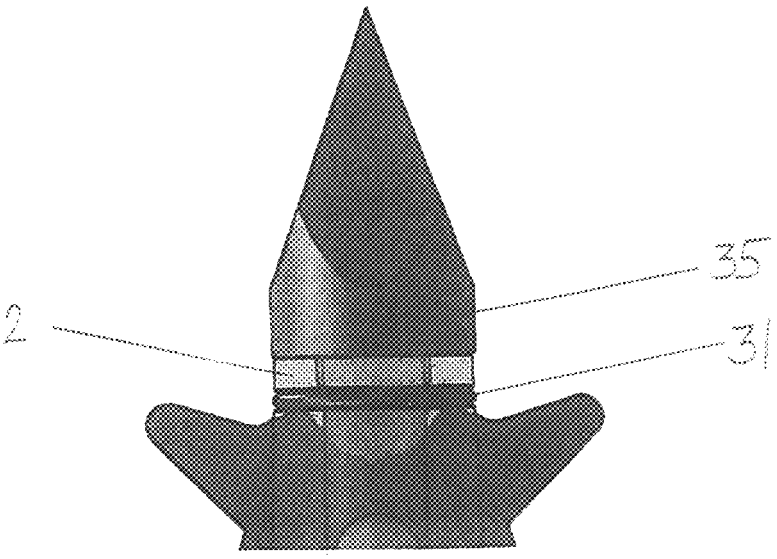
FIG. 20 is a view of another detachable tip that may be attached to the housing body. With a detachable tip, it allows the blades to be removed from the body while still being coupled together.

In FIG. 20 is another embodiment illustrating a removable tip 35 that can be coupled to housing body 2 with threads, glue, press fit, or any other means of securing a tip to housing body 2.

Figure 21:
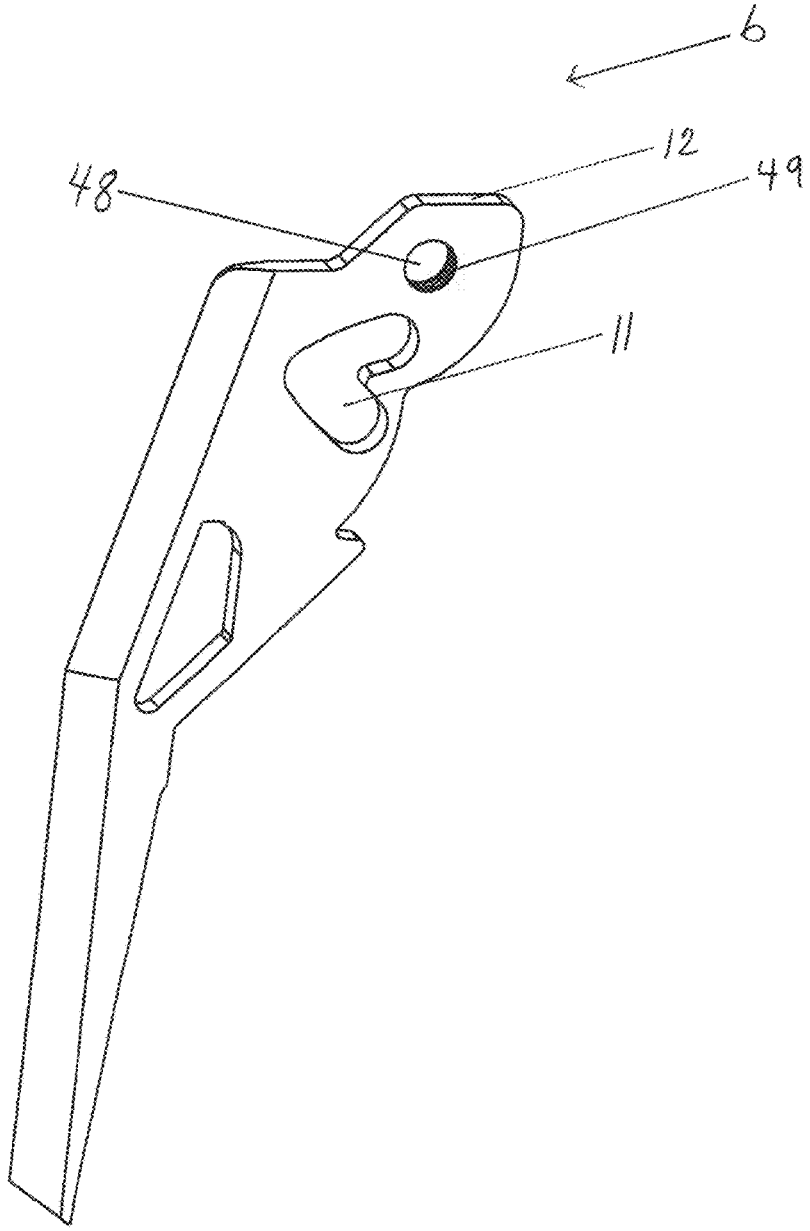
FIG. 21 is another view of an example first blade (as shown in FIG. 8) with threaded holes for receiving a blade extension.

In FIG. 21 is an angled view of another blade embodiment, showing an opening 48 and a threaded portion 49 for blade extension 13 to be coupled to blade 6. This illustration and embodiment allows blade extension 13 to be detachable and can allow blades 6 and 7 to be detached from housing body 2.

Figure 22:
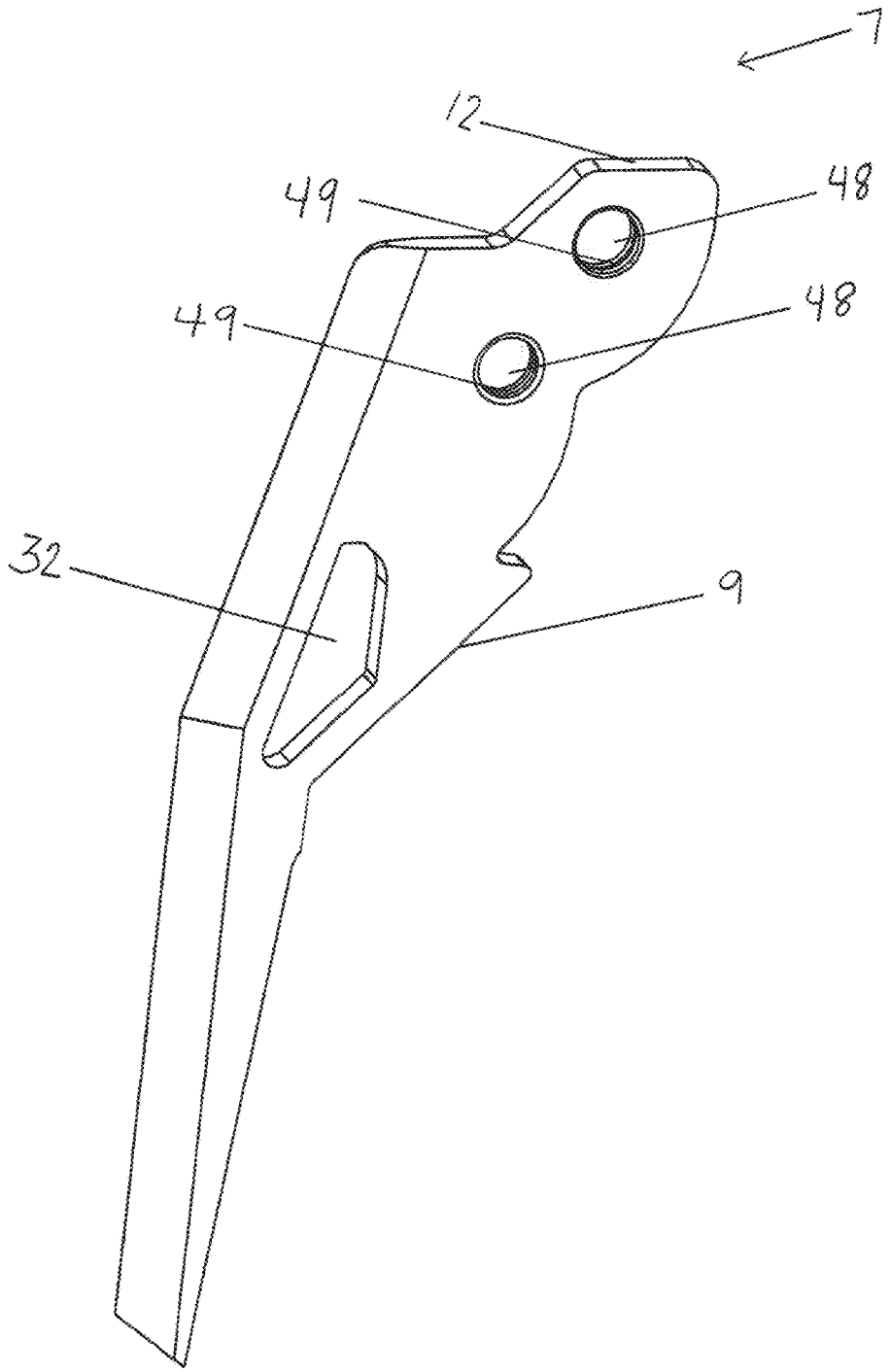
FIG. 22 is another view of an example second blade (as shown in FIG. 7) with threaded holes for receiving blade extensions.

In FIG. 22 is another angled view of a blade embodiment showing openings 48 and threaded portions 49 for blade extension 14 and 15 to be coupled to blade 7. This illustration and embodiment allows blade extension 14 and 15 to be detachable and can allow blades 6 and 7 to be removed from elongated groove 21 of housing body 2. It should also be noted that there are other ways to couple blade extensions 14 and 15 to blade 7 by utilizing a pin, press fit pin, glued pin, nut and flat bolt, welded portion, bent portion, bump out, composite, molded extension, forged extension, or other means for blade extensions or for coupling blade extensions.

Figure 23:
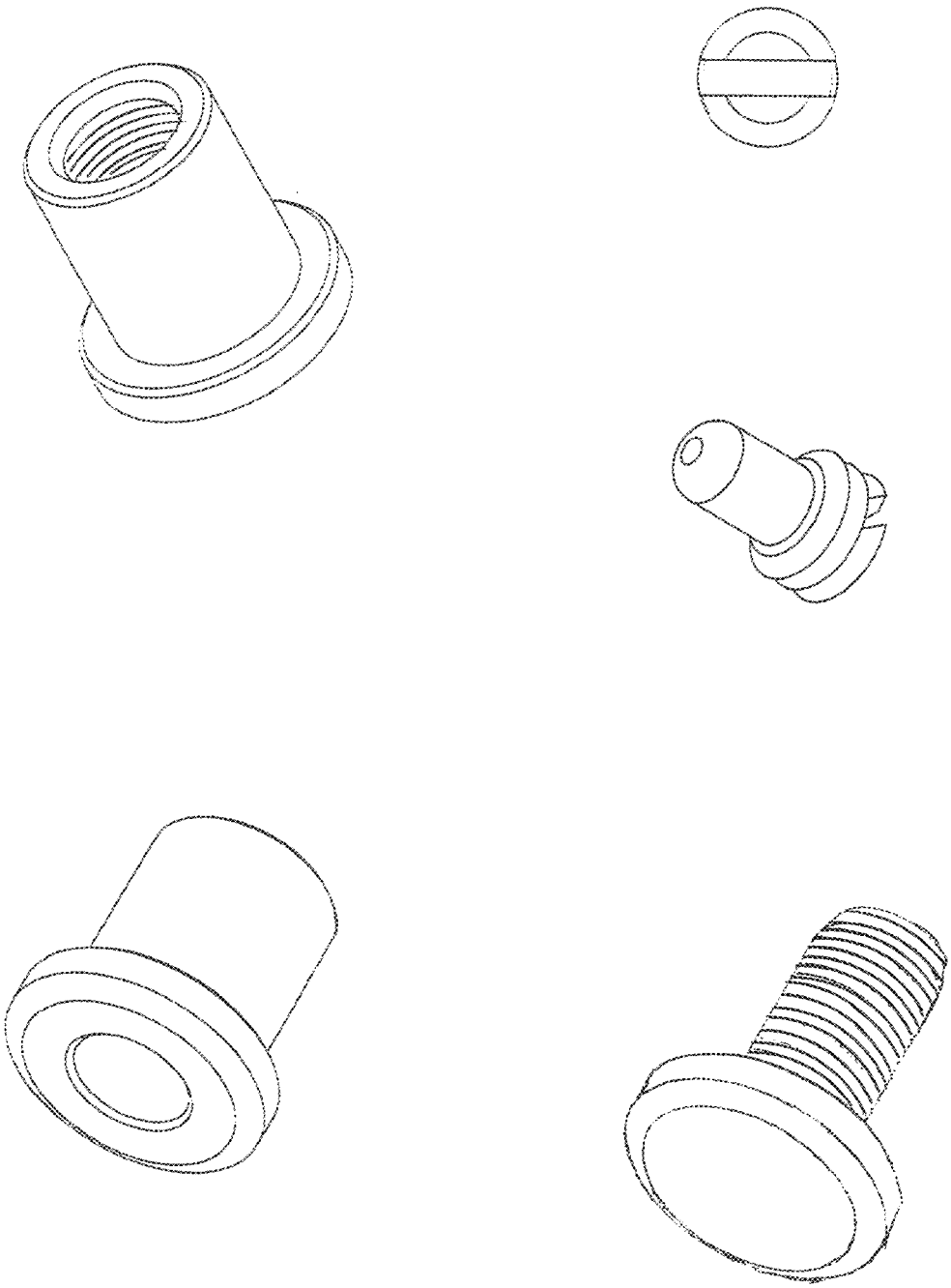
FIG. 23 is an illustration of further examples of various blade extensions and blade coupling devices.

In FIG. 23 is yet another illustration of various embodiments of blade extensions and blade coupling devices for the current disclosure. These embodiments are pins, press fit embodiments, and threaded embodiments.

Figure 24:
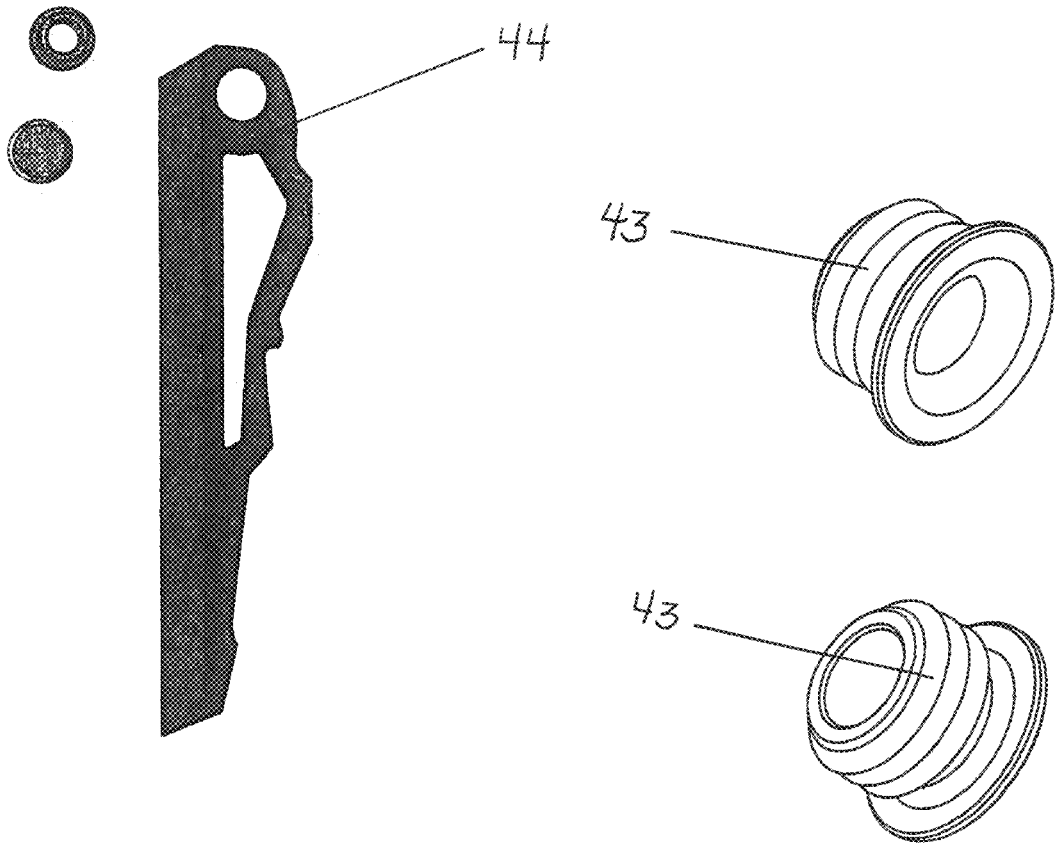
FIG. 24 are more examples of a blade extension or blade coupling device and another blade.

In FIG. 24 is yet another illustration of a blade coupling or blade extension device 43 and another blade example 44.

Figure 25:
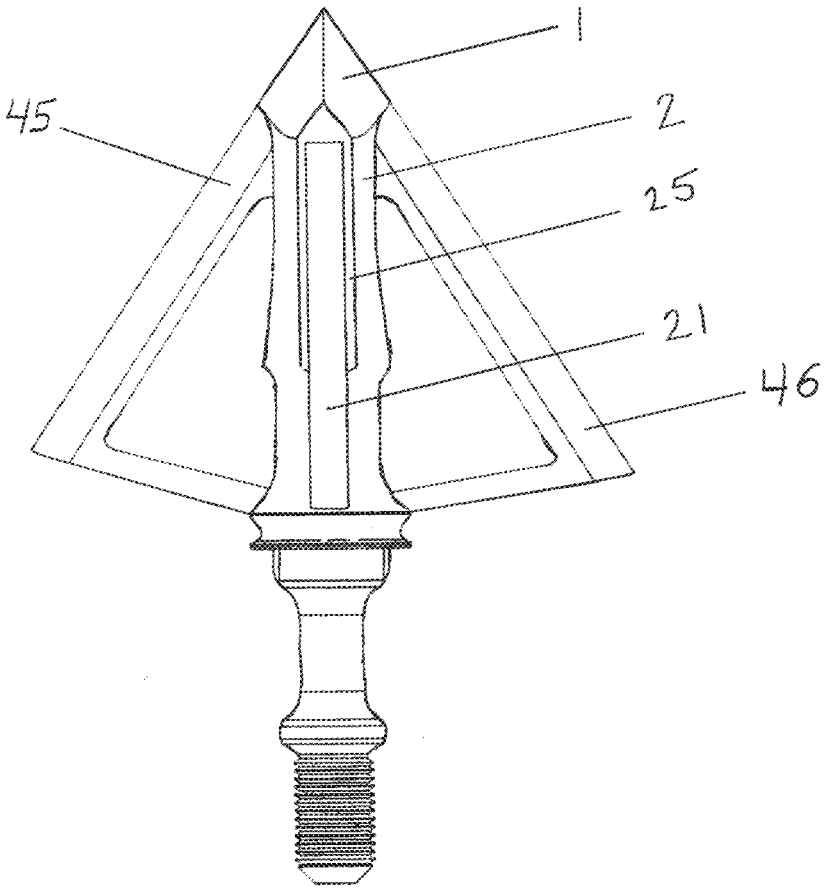
FIG. 25 is another embodiment with a housing body having additional blades that are coupled to the side while still having an elongated groove to receive additional blades.

In FIG. 25 is an embodiment with additional blades 45 and 46 that are attached to housing body 2. This illustration also shows how there can be blades 6 and 7 (not shown in this drawing) within the elongated groove 21 while still having additional cutting blades in housing body 2. It should be noted that the blades can also extend into or over the top portion of housing body 2 or over the tip 1.

In some embodiments, an arrow broadhead may comprise a housing body having an elongated groove extending through a portion of the housing body and a first and a second cutting blade extended through the elongated groove. The first and second cutting blades have at least one detachable extension that contains the blades to the housing body. The broadhead may further comprise at least one extension on at least one blade that slides and rotates on an outside portion of the housing body. The broadhead may further comprise an angled slope on the outside portion of the housing body, wherein the blade extension slides over and locks the blades into an extended cutting position. The first and second cutting blades may be coupled together yet configured to move independently of each other. The broadhead may further comprise a blade retention device holding the first and second cutting blades in a retracted position during arrow flight. The blade retention device may comprise a tension clip. The tension clip may be configured to hook on the blades holding them in a retracted in-flight position. The broadhead may further comprise an elongated groove in at least one cutting blade and a member in the second cutting blade configured to couple the blades within the elongated groove in the housing body. The broadhead may further comprise a notch portion on at least one cutting blade that locks on a portion of the housing body to keep the blades in a locked expanded cutting position.

In some embodiments, the blade extension may pry and press against the outer portion of the housing body locking the blades in an expanded cutting position.

In some embodiments, a broadhead may comprise a blade retention device that presses against the blades keeping them in a retracted in-flight position.

The arrangements of the broadheads, as shown, are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited herein. Accordingly, all such modifications are intended to be included within the scope of the present disclosure as described herein. The order sequence of any process or method steps may be varied or re-sequenced according to alternative embodiments. Other substitutions, modifications, changes, and/or omissions may be made in the design, operating conditions and arrangement of the preferred and other exemplary embodiments without departing from the scope of the present disclosure as expressed herein. It should also be understood that changes in the embodiments to the disclosed invention are meant to be included as coming within the scope of the claims.

What is claimed is:

1. A broadhead comprising:

at least two overlapping blades received within an elongated groove, each blade having a blade extension, the blade extensions extending in opposite directions, further comprising a receiving slot in at least one cutting blade and an extension in the second cutting blade that couples the blades within the elongated groove.

2. The broadhead described in claim 1, wherein at least one of the overlapping blades comprises an elongated groove for receiving a member.

3. The broadhead described in claim 2, wherein the member is configured to be an extension from at least one blade.

4. The broadhead described in claim 3, wherein the member is configured to move freely within an elongated groove within at least one blade.

5. The broadhead described in claim 1, wherein the blades are held in a retracted position by a blade retaining device.

6. The broadhead described in claim 5, wherein the blade retaining device comprises a tension clip.

7. The broadhead described in claim 1, further comprising a notch portion of at least one cutting blade that locks on a portion of the housing body to lock the blades into an expanded cutting position.

8. The broadhead described in claim 1, wherein at least one blade extension on at least one blade pushes against a portion of the housing body to lock the blade into an expanded cutting position.

9. The broadhead as described in claim 1, further comprising a housing body with the elongated groove with at least one fixed blade.

10. A broadhead comprising:

a housing body having an elongated groove through a portion of the housing body;

a first blade having an extension and a second cutting blade having an extension on a side opposite a side contacting the first blade;

wherein the first and second cutting blades are overlapping each other and coupled together and disposed within the elongated groove and are configured to move independently of each other.

11. The broadhead as described in claim 10, wherein at least one of the first and second blades comprises a receiving slot.

12. The broadhead as described in claim 10, wherein at least one of the first and second blades comprises a second extension.

13. The broadhead as described in claim 12, wherein the first and second blades are coupled together with an extension within the cutting blades.

14. The broadhead as described in claim 10, wherein at least one of the first and second blade comprises at least one removable blade extension.

15. The broadhead as described in claim 10 further including a housing body having an elongated groove therethrough;

a removable tip received in an upper portion of the groove and attached to a top portion of the housing body;

a first cutting blade extending through the elongated groove with an extension on a top portion of the blade;

a second cutting blade extending through the elongated groove with an extension on a top portion of blade;

the first and second cutting blades coupled together;

whereby, when the first and second cutting blades contact the target, the first and second cutting blades move rearwardly and outwardly into an expanded position for cutting and target penetration.

16. A broadhead adapted for moving from a retracted position during arrow flight to an expanded position when contacting a target, the broadhead comprising:

a housing body having an elongated groove extended through at least a portion of the housing body;

a first and second cutting blade disposed at least partially within the groove and each having an extension on at least one portion of the blade;

the first and second cutting blades coupled to be received within the elongated groove;

wherein the first and second cutting blades are configured to move and pivot within the groove and are held by at least one blade extension on the outside of the housing body whereby the at least one cutting blade extension presses against the housing body, holding the cutting blade in an expanded, locked cutting position.

17. The broadhead as described in claim 16, further including at least one extension on the first and second blade that slide on the outside of the housing body.

18. The broadhead as described in claim 16, wherein the first and second cutting blades overlap one another and are coupled together within the elongated groove.

19. The broadhead as described in claim 16, where in the first and second cutting blades extend outside the housing body through the elongated groove.

20. The broadhead as described in claim 16, wherein the blade extension can be any portion or extension to the blade that is non-parallel to the flat surface of the blade.

21. The broadhead as described in claim 16, wherein the blade extension locks into the housing body holding the cutting blade into an expanded cutting position.

22. The broadhead as described in claim 16, further including a removable tip.

23. The broadhead as described in claim 16, wherein the blade retaining device hooks over a portion of the blades.

* * * * *